US011376658B2

(12) United States Patent
Ishii et al.

(10) Patent No.: US 11,376,658 B2
(45) Date of Patent: Jul. 5, 2022

(54) NICKEL POWDER, METHOD FOR MANUFACTURING NICKEL POWDER, INTERNAL ELECTRODE PASTE USING NICKEL POWDER, AND ELECTRONIC COMPONENT

(71) Applicants: SUMITOMO METAL MINING CO., LTD., Tokyo (JP); MURATA MANUFACTURING CO., LTD., Kyoto (JP)

(72) Inventors: Junji Ishii, Tokyo (JP); Shingo Murakami, Tokyo (JP); Hiroyuki Tanaka, Tokyo (JP); Takahiro Kamata, Tokyo (JP); Toshiaki Terao, Tokyo (JP); Masaya Yukinobu, Tokyo (JP); Yuji Watanabe, Kyoto (JP); Tsutomu Tanimitsu, Kyoto (JP); Yoshiyuki Kunifusa, Kyoto (JP); Haruo Nishiyama, Kyoto (JP)

(73) Assignees: SUMITOMO METAL MINING CO., LTD., Tokyo (JP); MURATA MANUFACTURING CO., LTD., Kyoto (JP)

( * ) Notice: Subject to any disclaimer, the term of this patent is extended or adjusted under 35 U.S.C. 154(b) by 160 days.

(21) Appl. No.: 16/085,148

(22) PCT Filed: Mar. 14, 2017

(86) PCT No.: PCT/JP2017/010134
§ 371 (c)(1),
(2) Date: Sep. 14, 2018

(87) PCT Pub. No.: WO2017/159659
PCT Pub. Date: Sep. 21, 2017

(65) Prior Publication Data

US 2019/0084040 A1 Mar. 21, 2019

(30) Foreign Application Priority Data

Mar. 18, 2016 (JP) ..... JP2016-056119

(51) Int. Cl.
*B22F 1/00* (2022.01)
*B22F 1/065* (2022.01)
(Continued)

(52) U.S. Cl.
CPC ..... *B22F 1/065* (2022.01); *B22F 1/16* (2022.01); *B22F 9/24* (2013.01); *C22C 19/03* (2013.01);
(Continued)

(58) Field of Classification Search
None
See application file for complete search history.

(56) References Cited

U.S. PATENT DOCUMENTS 6,007,743 A 12/1999 Asada et al.
6,343,002 B1 * 1/2002 Shimizu ..... H01G 4/0085 361/321.4
(Continued)

FOREIGN PATENT DOCUMENTS

CN 105188992 A * 12/2015
JP H4-365806 A 12/1992
(Continued)

OTHER PUBLICATIONS

English translation of CN 105188992-A (originally published Dec. 23, 2015) from Espacenet.*
(Continued)

*Primary Examiner* — George Wyszomierski
(74) *Attorney, Agent, or Firm* — Katten Muchin Rosenman LLP

(57) ABSTRACT

To provide a fine nickel powder for an internal electrode paste of an electronic component, the nickel powder
(Continued)

obtained by a wet method and having high crystallinity, excellent sintering characteristics, and heat-shrinking characteristics. The nickel powder is obtained by precipitating nickel by a reduction reaction in a reaction solution including at least water-soluble nickel salt, salt of metal nobler than nickel, hydrazine as a reducing agent, and alkali metal hydroxide as a pH adjusting agent and water; the reaction solution is prepared by mixing a nickel salt solution including the water-soluble nickel salt and the salt of metal nobler than nickel with a mixed reducing agent solution including hydrazine and alkali metal hydroxide; and the hydrazine is additionally added to the reaction solution after a reduction reaction initiates in the reaction solution.

5 Claims, 10 Drawing Sheets

(51) Int. Cl.

| | |
|---|---|
| ***B22F 9/24*** | (2006.01) |
| ***H01B 1/22*** | (2006.01) |
| ***H01B 1/02*** | (2006.01) |
| ***C22C 19/03*** | (2006.01) |
| ***B22F 1/16*** | (2022.01) |

(52) U.S. Cl.
CPC ..... *H01B 1/02* (2013.01); *H01B 1/22* (2013.01); *B22F 2301/15* (2013.01); *B22F 2304/054* (2013.01); *B22F 2304/056* (2013.01); *B22F 2304/058* (2013.01); *B22F 2999/00* (2013.01)

(56) References Cited

U.S. PATENT DOCUMENTS

| | | | | |
|---|---|---|---|---|
| 6,379,419 | B1 | 4/2002 | Celik et al. | |
| 6,402,803 | B1 * | 6/2002 | Katayama | B22F 9/28 75/246 |
| 6,503,560 | B2 | 1/2003 | Toshima et al. | |
| 6,592,645 | B1 * | 7/2003 | Mizutani | H01G 4/008 75/365 |
| 6,863,708 | B2 * | 3/2005 | Kagohashi | B22F 9/28 75/364 |
| 8,343,253 | B2 | 1/2013 | Watanabe | |
| 2005/0221088 | A1 * | 10/2005 | Celik | B22F 1/0088 428/403 |
| 2007/0277648 | A1 | 12/2007 | Paserin et al. | |
| 2009/0025510 | A1 | 1/2009 | Lee et al. | |
| 2014/0319712 | A1 | 10/2014 | Shimizu et al. | |
| 2015/0001437 | A1 * | 1/2015 | Carpenter | H01F 1/11 252/62.51 R |
| 2015/0027765 | A1 * | 1/2015 | Kim | B22F 1/0018 174/260 |
| 2015/0283616 | A1 | 10/2015 | Maekawa et al. | |
| 2016/0271700 | A1 | 9/2016 | Akimoto et al. | |

FOREIGN PATENT DOCUMENTS

| | | | |
|---|---|---|---|
| JP | H08246001 | A | 9/1996 |
| JP | 2002-053904 | A | 2/2002 |
| JP | 2002-530521 | A | 9/2002 |
| JP | 2014029010 | A | 2/2014 |
| JP | 2015-160964 | A | 9/2015 |
| JP | 2015-190043 | A | 11/2015 |

OTHER PUBLICATIONS

International Search Report and Written Opinion dated Jun. 6, 2017, from International Application No. PCT/JP2017/010134, 9 sheets.

Hiroyasu Mitani, Masaru Yokota, "Mudenkai Ni Mekki Cu Fukugo Funmatsu o Shiyo shita Cu—Y2 (Cu9Al4)—Ni-kei Kongo Atsufuntai no Shoketsu Katei ni Tsuite" ("A Study on the Sintering Characteristics of Cu—Y2 (Cu9Al4)—Ni Mixed Powder Compacts by Using the Nickel Plated Composite Powders"), Journal of the Japan Institute of Metals, 1972, vol. 36, No. 12, pp. 1189 to 1195, ISSN: 0021-4876.

* cited by examiner

LT CROSS SECTIONAL VIEW

NICKEL POWDER, METHOD FOR MANUFACTURING NICKEL POWDER, INTERNAL ELECTRODE PASTE USING NICKEL POWDER, AND ELECTRONIC COMPONENT

TECHNICAL FIELD

The present invention relates to nickel powder that is a constituent material of an internal electrode paste used as an electrode material of electronic components such as multilayer ceramic components, especially relates to nickel powder obtained by a wet method, and manufacturing method of the nickel powder using the wet method, and an internal electrode paste using the nickel powder and electronic components using the internal electrode paste as an electrode material.

BACKGROUND ART

Nickel powder is used as a material of a capacitor that is an electronic component constituting an electronic circuit, especially as a material of a thick film conductor that constitutes such as an internal electrode of multilayer ceramic components such as a multilayer ceramic capacitor (MLCC) and multilayer ceramic substrate.

In recent years, multilayer ceramic capacitors have become to have a larger capacity, and the amount of usage of internal electrode paste that is used for forming a thick film conductor constituting an internal electrode of a multilayer ceramic capacitor has also been increased. Therefore, as a metal powder for an internal electrode paste, inexpensive base metals mainly such as nickel have been used as a substitute for expensive noble metals.

Multilayer ceramic capacitors are manufactured in the following process. First, an internal electrode paste obtained by kneading and mixing nickel powder, a binder resin such as ethyl cellulose, and an organic solvent such as terpineol is printed on a dielectric green sheet with a screen printing. Then, the dielectric green sheet where this internal electrode paste has been printed is laminated and crimped such that the internal electrode paste and dielectric green sheet are alternately superposed to obtain a laminate. Further, the obtained laminate is cut into a specified size, and after removing the binder resin by heating (hereinafter referred to as "debinding treatment"), the laminate is calcined at a high temperature of about 1300° C. to obtain a ceramic compact. Lastly, a multilayer ceramic capacitor is obtained by attaching an external electrode to the obtained ceramic compact.

As base metals such as nickel are used as a metal powder in the internal electrode paste, the debinding treatment of the laminate is performed in an atmosphere such as an inert atmosphere where the oxygen concentration is extremely low.

As a multilayer ceramic capacitor has become smaller and become to have a larger capacity, an internal electrode and dielectric have also made to become thinner. As a result, the particle diameter of a nickel powder used for an internal electrode paste has been also made to become finer, and a nickel powder having an average particle diameter of 0.5 μm or less is required at the present, and a nickel powder having an average particle diameter of 0.3 μm or less is mainly used.

The manufacturing method of nickel powder can be classified roughly into a vapor phase method and wet method. As the vapor phase method, there is a manufacturing method of nickel powder disclosed in JPH4-365806 (A) that reduces nickel chloride vapor using hydrogen, and a manufacturing method of nickel powder disclosed in JP 2002-530521 (A) that vaporizes nickel metal in plasma. On the other hand, as the wet method, there is a manufacturing method of nickel powder disclosed in JP2002-053904 (A) that adds a reducing agent to a nickel salt solution.

Although the vapor phase method is an effective mean to obtain a nickel powder having an excellent characteristic in crystallinity, as it is a process performed at a high temperature of about 1000° C. or more, there is a problem that the particle diameter distribution of the obtained nickel powder becomes wide. As stated above, when making an internal electrode thinner, large diameter particles are not included and a nickel powder having a relatively narrow particle diameter distribution and having an average particle diameter of 0.5 μm or less is required. Therefore, in order to obtain such a nickel powder by the vapor phase method, a classification treatment should be essential by introducing an expensive classifier.

Here, in the classification treatment, it is possible to remove large diameter particles that are larger than the classification point that is an arbitrary value of about 0.6 μm to 2 μm, however, this removes part of particles that are smaller than the classification point at the same time. Like this, when the classification treatment was employed, there is a disadvantage that the recovery percentage of nickel powder is greatly reduced. Therefore, when performing the classification treatment, products should be expensive also because of introducing an expensive facility such as the one stated above.

Moreover, as for the nickel powder obtained by the vapor phase method and having an average particle diameter of 0.2 μm or less, especially those having an average particle diameter of 0.1 μm or less, it should be difficult to remove large diameter particles by a classification treatment having the smallest classification point of about 0.6 μm. Therefore, the vapor phase method that requires such a classification treatment cannot be employed for a future internal electrode that would be even thinner.

On the other hand, compared to the vapor phase method, the wet method has an advantage that the particle diameter distribution of the obtained nickel powder is narrow. Especially, in a method disclosed in JP2002-053904 (A), nickel powder is manufactured by adding a solution that includes hydrazine as a reducing agent to a solution that includes a copper salt and nickel salt. In this method, nickel salt (accurately, nickel ion ($Ni^{2+}$), or nickel complex ion) is reduced by hydrazine in the coexistence of metal salt (nucleating agent) that is a nobler metal than nickel. Therefore, it is known that the particle diameter is controlled by controlling the number of nucleation occurrence, and fine nickel powder having a narrower particle diameter distribution can be obtained due to the uniformity of nucleation and particle growth.

However, when the nickel powder obtained by the wet method is applied to an internal electrode paste for an internal electrode of a multilayer ceramic capacitor, there is a problem that the sintering characteristics and heat-shrinking characteristics thereof deteriorate. Especially, in a multilayer ceramic capacitor that has been made to be thinner, deterioration of the electrode continuity of an internal electrode becomes apparent and the electrical characteristics of a multilayer ceramic capacitor may be greatly deteriorated.

PATENT LITERATURE

[Patent Literature 1] JPH4-365806
[Patent Literature 2] JPT 2002-530521
[Patent Literature 3] JP2002-053904

SUMMARY OF INVENTION

Problem to be Solved by Invention

The present invention is to provide fine nickel powder having a high crystallinity even when it is obtained by the wet method, and the fine nickel powder shows excellent sintering characteristics and heat-shrinking characteristics when applied to an internal electrode paste for an internal electrode of a multilayer ceramic capacitor (MLCC); the present invention is to provide such fine nickel powder simply and inexpensively; and the present invention is to provide internal electrode paste using such nickel powder and electronic components such as a multilayer ceramic capacitor using this internal electrode paste.

Means for Solving Problems

The nickel powder of the present invention is characterized in that it has nearly spherical particle shape, the average particle diameter of 0.05 μm to 0.5 μm, crystallite diameter of 30 nm to 80 nm, and the amount of nitrogen of 0.02% by mass or less.

In the nickel powder of the present invention, it is preferable that the amount of alkali metal element is 0.01% by mass or less.

When heating a pellet that is formed by pressurizing and molding the nickel powder of the present invention from 25° C. to 1200° C. in an inert atmosphere or a reducing atmosphere and measuring the thermal shrinkage of the pellet based on the thickness of the pellet at 25° C., it is preferable that the maximum shrinkage temperature that is a temperature at the maximum shrinkage where the thermal shrinkage becomes maximum is 700° C. or more, the maximum shrinkage that is the maximum value of the thermal shrinkage at the maximum shrinkage temperature is 22% or less, and the maximum expansion amount of the pellet from the pellet at the maximum shrinkage based on the thickness of the pellet at 25° C. in a temperature range of the maximum shrinkage temperature or more and 1200° C. or less is 7.5% or less. More specifically, the maximum expansion amount of the pellet from the pellet at the maximum shrinkage can be obtained as a difference between "the maximum value (the maximum shrinkage) of thermal shrinkage at the maximum shrinkage temperature in a temperature range of 700° C. or more and 1200° C. or less based on the thickness of the pellet at 25° C." and "the thermal shrinkage at a point where the pellet is most expanded in a temperature range of the maximum shrinkage temperature or more and 1200° C. or less based on the thickness of the pellet at 25° C.".

The nickel powder of the present invention preferably includes sulfur (S) at least on a surface thereof, and the amount of sulfur in the nickel powder is preferably 1.0% by mass or less.

In the nickel powder of the present invention, the CV value (coefficient of variation) that indicates the ratio of a standard deviation of the particle diameter of the nickel powder to the average particle diameter is preferably 20% or less.

The manufacturing method of nickel powder of the present invention has a crystallization process to obtain nickel crystallization powder by precipitating nickel by a reduction reaction in a reaction solution that includes at least water-soluble nickel salt, metal salt of metal that is nobler than nickel, hydrazine as a reducing agent, alkali metal hydroxide as a pH adjusting agent, and water. The reaction solution is prepared by mixing a nickel salt solution that includes the water-soluble nickel salt and the metal salt of metal that is nobler than nickel with a mixed reducing agent solution that includes the hydrazine and the alkali metal hydroxide; or by mixing a nickel salt solution that includes the water-soluble nickel salt and the metal salt of metal that is nobler than the nickel with a reducing agent solution that includes the hydrazine but does not include the alkali metal hydroxide and then adding an alkali metal hydroxide solution that includes the alkali metal hydroxide thereto.

It is especially characterized in that, in the manufacturing method of nickel powder of the present invention, the hydrazine is additionally added to the reaction solution after the reduction reaction initiates in the reaction solution.

In the manufacturing method of nickel powder of the present invention, the amount of initial hydrazine that is hydrazine among the hydrazine being formulated in the mixed reducing agent solution is in a range of 0.05 to 1.0 at a molar ratio to nickel; and, the amount of additional hydrazine that is hydrazine among the hydrazine being additionally added to the reaction solution is in a range of 1.0 to 3.2 at a molar ratio to nickel.

The additional hydrazine can be additionally added over multiple times, or it can be additionally added by dripping continuously.

When the additional hydrazine is added by dripping continuously, it is preferable that the dripping speed is in a range of 0.8/h to 9.6/h at a molar ratio to nickel.

As the metal salt of metal that is nobler than nickel, it is preferable to employ at least any one of a copper salt, and one or more noble metal salts selected from gold salt, silver salt, platinum salt, palladium salt, rhodium salt, and iridium salt.

In this case, it is preferable to concurrently use the copper salt and the noble metal salt, and the molar ratio of the noble metal salt to the copper salt (the number of moles of noble metal salt/the number of moles of copper salt) is within a range of 0.01-5.0.

As the hydrazine, it is preferable to use purified hydrazine where organic impurities included in hydrazine have been removed.

As the alkali metal hydroxide, it is preferable to use any one of sodium hydroxide, potassium hydroxide, and a mixture of these.

It is preferable to include complexing agent to at least one of the nickel salt solution and the reducing agent solution.

In this case, as the complexing agent, it is preferable to use one or more selected from hydroxy carboxylic acid, hydroxy carboxylic acid salt, hydroxy carboxylic acid derivatives, carboxylic acid, carboxylic acid salt, and carboxylic acid derivatives, and it is preferable to make the amount of the complexing agent to be within a range of 0.05 to 1.2 in a molar ratio to nickel.

In the manufacturing method of nickel powder of the present invention, it is preferable to make the reaction initiation temperature that is a temperature of the reaction solution at the initiation of the crystallization reaction to be within a range of 0° C. to 95° C.

It is preferable to add a sulfur coating agent to nickel powder slurry that is an aqueous solution including nickel powder obtained in the crystallization process and modificate the surface of the nickel powder with sulfur.

As the sulfur coating agent, it is preferable to use water-soluble sulfur compounds that includes at least either of mercapto group (—SH) or disulfide group (—S—S—).

The internal electrode paste of the present invention is characterized in that it includes nickel powder and organic solvent and the nickel powders are constructed by the nickel powder of the present invention.

The electronic components of the present invention is characterized in that it comprises at least an internal electrode, and the internal electrode is constructed by a thick film conductor that is formed using the internal electrode paste of the present invention.

Effect of Invention

Although the nickel powder of the present invention is a nickel powder that is obtained by a wet method, it has a narrow particle diameter distribution and a low concentration of impurities such as nitrogen (N) and alkali metal element, and therefore, in an internal electrode paste using this nickel powder, it is possible to suppress deterioration of sintering characteristics and heat-shrinking characteristics due to the impurities. As a result, it is possible to maintain electrode continuity at a high level in a thick film conductor after calcining the internal electrode paste and suppress deterioration of electrical characteristics of electronic components, so the nickel powder of the present invention is more suitable for making the layers of an internal electrode of a multilayer ceramic capacitor thinner.

Further, according to the manufacturing method of nickel powder of the present invention, in a crystallization process of a wet method, the crystallinity of the obtained nickel powder (nickel crystallization powder) can be effectively higher by adding hydrazine as a reducing agent to a reaction solution over multiple times (hereinafter referred to as "divided addition"). As a result, it becomes possible to manufacture the nickel powder of the present invention that is suitable as a material for an internal electrode paste and an internal electrode that is manufactured by using the internal electrode paste simply and inexpensively.

MODES FOR CARRYING OUT INVENTION

Figure 1:
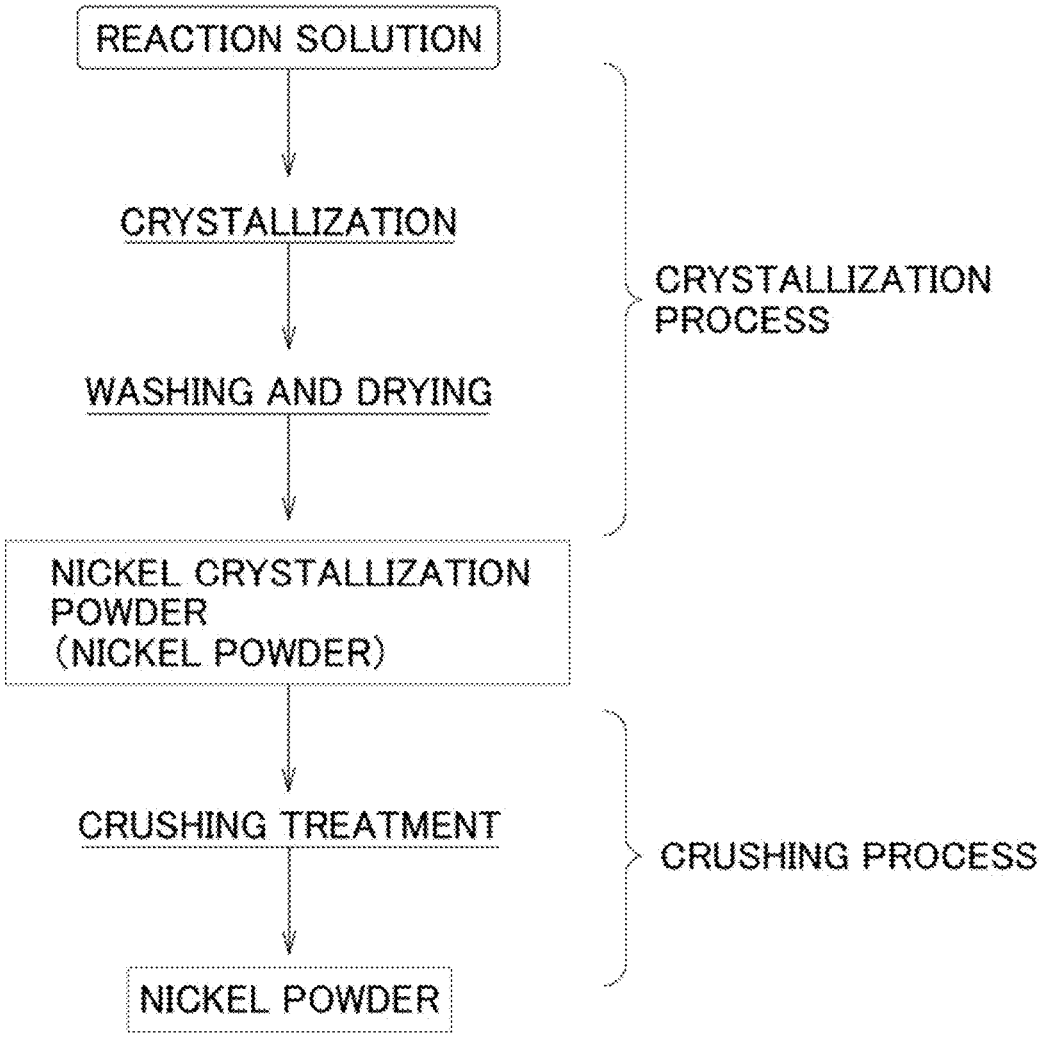
FIG. 1 is a flowchart showing an example of a basic manufacturing process in the manufacturing method of nickel powder of the present invention.

The inventors of the present invention focus on a crystallization reaction of nickel powder in a wet method, that is, the series of reactions in a reaction solution, that includes nickel salt and hydrazine as a reducing agent, from the occurrence of the initial nucleus that are extremely fine nickel particles that are precipitated by a reduction reaction to the particle growth. As a result of optimizing each condition of the crystallization process, the inventors have discovered that the amount of nitrogen and alkali metal elements that arise from the chemical ingredients in the reaction solution can be greatly reduced. The present invention was completed based on this kind of findings.

The details of the nickel powder of the present invention and the manufacturing method thereof is explained hereinafter. Here, the present invention is not limited to the following embodiments and it is possible to add many kinds of modifications to the present invention as long as they do not deviate from the scope of the present invention.

Regarding the nickel powder of the present invention, one that is obtained by the crystallization process is especially described as nickel crystallization powder. Although the nickel crystallization powder as it is can be used as a nickel powder, a powder obtained after performing cracking treatment etc. to the nickel crystallization powder can be used as a nickel powder as described later.

(1) Nickel Powder

The nickel powder of the present invention is obtained by a wet method. It is characterized in that it has nearly spherical particle shape, an average particle diameter of 0.05 μm to 0.5 μm, a crystallite diameter of 30 nm to 80 nm; and the amount of nitrogen is 0.02% by mass or less, and the amount of alkali metal element is 0.01% by mass or less.

(Particle Shape)

The nickel powder of the present invention preferably has nearly spherical particle shape with high spheroidicity, for example, from the viewpoint etc. of electrode continuity in an internal electrode. Nearly spherical shape is a shape that is spherical or oval, or a shape that can be substantially regarded as spherical or oval.

(Average Particle Diameter)

The average particle diameter of the nickel powder of the present invention means the particle diameter of the number average obtained from a photograph of a scanning electron microscope (SEM) of a nickel powder. Specifically, the average particle diameter of nickel powder can be obtained by processing the image of a SEM photograph to measure the area of individual nickel particles, calculating the diameter of each nickel particles by perfect circle conversion from the area, then calculating its average value.

The average particle diameter of the nickel powder of the present invention is within a range of 0.05 μm to 0.5 μm, preferably within a range of 0.1 μm to 0.3 μm. By making the average particle diameter of nickel powder to be 0.5 μm or less, it becomes possible to suitably apply to an internal electrode of a thin-layered multilayer ceramic capacitor (MLCC). From this viewpoint, the lower limit of the average particle diameter is not especially limited, but by making the average particle diameter of nickel powder to be 0.05 μm or more, the handling of dry nickel powder becomes easier.

(CV Value of Particle Diameter)

Although a nickel powder is obtained by a wet method in the present application, it becomes possible to obtain a nickel powder having a narrow particle diameter distribution due to addition conditions of a metal salt of metal that is nobler than nickel. As an index of this particle diameter distribution, it can be expressed as a CV (coefficient of variation) value that is a value which is calculated by dividing a standard deviation of the particle diameter by its average particle diameter [(standard deviation of particle diameter/average particle diameter)×100]. The CV value of the nickel powder of the present invention is preferably 20% or less, more preferably 15% or less. When the CV value of the nickel powder exceeds 20%, it may be difficult to be applied to a thin-layered multilayer ceramic capacitor due to a wide particle diameter distribution. The lower limit of the CV value is not especially limited because the narrower the particle diameter distribution is better.

(Crystallite Diameter)

Crystallite diameter is also referred to as crystallite size. It is an index showing the degree of crystallization and a larger crystallite diameter indicates higher crystallization. The crystallite diameter of the nickel powder of the present invention obtained by the wet method is within a range of 30 nm to 80 nm, however, it is preferable to be within a range of 35 nm to 80 nm, more preferably to be within a range of 45 nm to 80 nm.

When the crystallite diameter is less than 30 nm, as stated above, the amount of impurities including nitrogen and alkali metal elements is not reduced as there exist many crystal grain boundaries. Therefore, when it is applied to an internal electrode of a multilayer ceramic capacitor, especially in a multilayer ceramic capacitor that has been made to be thinner, the electrode continuity obviously lowers and the electrical characteristics of the multilayer ceramic capacitor greatly deteriorate.

In the present invention, the upper limit of the crystallite diameter is set to be 80 nm, however, there is no problem regarding the characteristics of the nickel powder even when the crystallite diameter exceeds 80 nm and the effect of the present invention cannot be impaired. However, it is extremely difficult to manufacture nickel powder having a crystallite diameter that exceeds 80 nm as a crystallization powder of the wet method. For example, it is possible to obtain the nickel crystallization powder of the present invention by heating it at about 300° C. or more in an inert atmosphere or a reducing atmosphere, however, the nickel particles are combined with each other while heating, that is, there is a problem that consolidated particles tend to be produced as the nickel particles sinter at their contact points. Therefore, it is preferable to set the upper limit to be 80 nm.

Here, the crystallite diameter of the nickel powder of the present invention is calculated by using Wilson method based on the diffraction data after performing an X-ray diffraction measurement. In Scherrer method that is generally used in measuring the crystallite diameter, the crystallite diameter and the crystal distortion are not distinguished and evaluated together, in a powder having a large crystal distortion, a value that is smaller than the crystallite diameter where the crystal distortion is not taken into consideration can be obtained. On the other hand, in Wilson method, the crystallite diameter and the crystal distortion are individually obtained, so that it is characterized in that a crystallite diameter that is not easily affected by crystal distortion can be obtained.

(Amount of Nitrogen and Amount of Alkali Metal)

In the process of crystallization of a nickel powder, hydrazine is used as a reducing agent. Nitrogen is included in the nickel powder as impurities due to the hydrazine which is a reducing agent. Further, as the higher the pH becomes, the reducing capacity of hydrazine is reinforced, alkali metal hydroxide is widely used as a pH adjusting agent. Alkali metal that is a component of these alkali metal hydroxides is included in the nickel powder as impurities as is the case with nitrogen.

These impurities such as nitrogen and alkali metal element that arise from chemical ingredients in the reaction solution will not be completely removed even if the nickel powder is plenty washed with pure water after the crystallization process and a certain amount remains in the nickel powder. Therefore, these impurities are thought to be not attached to the surface of nickel particles, but they have been taken into the nickel particles.

Regarding the impurities such as nitrogen and alkali metal element, it is assumed that they are taken into areas of nickel particles where the crystallinity of the crystal structure of nickel (face-centered cubic structure: fcc) is disturbed. That is, it is assumed that the impurities are taken into nickel particles in a state where they are interposed in the crystal grain boundary as elements. Therefore, relatively reducing the total area of the crystal grain boundary of the nickel powder, that is, increasing the crystallite diameter of the nickel powder for high crystallization seems to be effective for reducing the amount of impurities such as nitrogen and alkali metal element in the nickel powder.

The nickel powder of the present invention has a crystallite diameter of 30 nm or more and is highly crystallized, and it is constituted of large crystallite, the existence ratio of the crystal grain boundary is small. As a result, it is thought that the amount of impurities that are supposed to be taken into the crystal grain boundary is greatly lowered.

The amount of nitrogen that arises from hydrazine that is a reducing agent essential for the crystallization process of nickel powder in the nickel powder of the present invention is 0.02% by mass or less, preferably 0.015% by mass or less, more preferably 0.01% by mass or less.

Further, in the nickel powder of the present invention, the amount of alkali metal that arises from alkali metal hydroxide that is a pH adjusting agent added in order to reinforce the reduction of hydrazine is preferably 0.01% by mass or less, more preferably 0.008% by mass or less, even more preferably 0.005% by mass or less.

Here, alkali metal is sodium when sodium hydroxide is used as an alkali metal hydroxide, and it is potassium when potassium hydroxide is used. When sodium hydroxide and potassium hydroxide are both used, alkali metal is both sodium and potassium.

The amount of alkali metal in a nickel powder is affected by the degree of washing when washing a nickel powder obtained after the crystallization process. For example, when washing is not enough, the amount of alkali metal that arises from the reaction solution adhered to the nickel powder would be greatly increased. Here, the amount of alkali metal in the present invention is targeted on the alkali metal included in the internal portion of a nickel powder (mainly inside the crystal grain boundary), so that it means the amount of alkali metal in a nickel powder that is sufficiently washed with pure water. In the present invention, sufficient washing means washing where the conductivity of the filtrate of filter washing of nickel powder becomes 10 μS/cm or less when, for example, pure water having a conductivity of 1 μS/cm is used.

In the nickel powder of the present invention, the amount of nitrogen and alkali metal that are impurities arising from such chemical ingredients is reduced so that the thermal shrinkage behavior of nickel powder becomes good. On the other hand, when the amount of nitrogen that is included in a nickel powder exceeds 0.02% by mass, and/or the amount of alkali metal exceeds 0.01% by mass, when manufacturing a multilayer ceramic capacitor, the electrode continuity of a thick film conductor obtained by calcination of an internal electrode paste lowers due to deterioration of sintering characteristics and heat-shrinking characteristics of an internal electrode paste so that the electrical characteristics of a multilayer ceramic capacitor may deteriorate. Regarding the lower limit of the amount of nitrogen and alkali metal is not specifically limited. A nickel powder having an amount of nitrogen and alkali metal of the detection limit or less in a composition analysis by analytical instruments is also within the scope of the present invention.

(Thermal Shrinkage Behavior)

In the nickel powder of the present invention, by reducing the amount of impurities such as nitrogen and alkali metal that arise from the chemical ingredients in the reaction solution, the thermal shrinkage behavior becomes good when the nickel powder is sintered. That is, regarding a pellet that is formed by pressurizing the nickel powder of the present invention, when heating a pellet that is formed by pressurizing the nickel powder of the present invention from 25° C. to 1200° C. in an inert atmosphere or a reducing atmosphere and measuring the thermal shrinkage of the pellet based on the thickness of the pellet at 25° C., it is preferable that the maximum shrinkage temperature that is a temperature at the maximum shrinkage where the thermal shrinkage becomes maximum is 700° C. or more, the maximum shrinkage that is the maximum value (the maximum shrinkage) of the thermal shrinkage at the maximum shrinkage temperature is 22% or less, and the maximum expansion amount of the pellet from the pellet at the maximum shrinkage based on the thickness of the pellet at 25° C. in a temperature range of the maximum shrinkage temperature or more and 1200° C. or less is 7.5% or less. Here, this maximum expansion amount (high temperature expansion coefficient) is obtained as a difference between "the maximum value (the maximum shrinkage) of thermal shrinkage at the maximum shrinkage temperature of 700° C. or more and 1200° C. or less based on the thickness of the pellet at 25° C." and "the thermal shrinkage at a point where the pellet is most expanded in a temperature range of the maximum shrinkage temperature or more and 1200° C. or less based on the thickness of the pellet at 25° C.".

Impurities such as nitrogen and alkali metal are considered to be existed within the crystal grain boundary, however, among these, alkali metal inhibits the sintering when nickel powder is to be sintered. That is, alkali metal works to inhibit the crystal growth by suppressing the disappearance of the crystal grain boundary. Therefore, as the amount of alkali metal in a nickel powder increases, the sintering initiation temperature becomes higher so that acute thermal shrinkage occurs at the initiation of sintering. On the contrary, as the amount of alkali metal decreases, sintering occurs slowly from a low temperature so that thermal shrinkage at sintering proceeds slowly.

When heating is continued after thermal shrinkage of nickel powder, densification and crystal growth of sintered compact proceeds so that impurities of gas component elements such as nitrogen that was taken in the nickel powder (mainly within the crystal grain boundary) will be released. When the amount of nitrogen in the nickel powder is a lot, while released nitrogen gasifies and rapidly expands, gas movement to the exterior of the sintered compact is impaired due to the densification of the sintered compact, so it becomes a cause for the sintered compact of nickel powder itself largely expands.

As can be seen from the above, when the amount of nitrogen and alkali metal that are impurities is large, it causes rapid thermal shrinkage and a large expansion thereafter, which deteriorate the thermal shrinkage behavior. In the calcination treatment in manufacturing a multilayer ceramic capacitor, as the estrangement of thermal shrinkage behavior between the dielectric green sheet and nickel powder becomes larger, the electrode continuity of the thick film conductor obtained by calcination of the internal electrode paste becomes lower and it becomes a cause of deterioration of the electrical characteristics of the multilayer ceramic capacitor.

In the nickel powder of the present invention, the amount of impurities such as nitrogen and alkali metal is sufficiently reduced and rapid shrinkage and expansion after thermal shrinkage are suppressed, and therefore, by applying the nickel powder of the present invention, it is possible to achieve high electrode continuity in a thick film conductor and excellent electrical characteristics in electronic components such as a multilayer ceramic capacitor.

Here, the thermal shrinkage behavior of nickel powder of the present invention is measured by using a TMA (thermal mechanical analysis) device. TMA measures a change in dimension of a pellet that is a pressure molded nickel powder while heating it to measure its thermal shrinkage behavior. Here, the pellet is formed as a compact by, for example, filling powder to a cylindrical hole formed in a metal mold and compressing the powder with a pressure of about 10 MPa to 200 MPa.

Regarding the measurement of the thermal shrinkage behavior of a powder using TMA apparatus, it is preferable to measure in an inert atmosphere or a reducing atmosphere. An inert atmosphere is a noble gas atmosphere such as argon and helium, a nitrogen gas atmosphere, or a gas atmosphere where these are mixed. A reducing atmosphere is a gas atmosphere where hydrogen is mixed for 5 volume % or less to noble gas or nitrogen gas of an inert atmosphere. The amount of inert atmosphere gas or reducing atmosphere gas to flow into the TMA apparatus is preferably, for example, 50 ml/min to 2000 ml/min. In general, measurement of the thermal shrinkage behavior of a powder using TMA apparatus is performed in a temperature range that does not exceed 25° C. to a melting point. In a case of nickel powder, for example, it is possible to measure in a temperature range of 25° C. to 1200° C. The raising rate of temperature is preferably set to be 5° C./min to 20° C./min.

In the nickel powder of the present invention, when heating a pellet that is formed by pressurizing and molding this nickel powder from 25° C. to 1200° C. in an inert atmosphere or a reducing atmosphere and measuring the thermal shrinkage of the pellet, the maximum shrinkage temperature where the thermal shrinkage of the thickness of the pellet becomes maximum is 700° C. or more. The maximum shrinkage of the thickness of the pellet at the maximum shrinkage temperature based on the thickness of the pellet at 25° C. is 22% or less, preferably 20% or less, more preferably 18% or less. Further, in a temperature range between the maximum shrinkage temperature or more and 1200° C. or less, that is a temperature range where the nickel powder expands after thermally shrunk, the high temperature expansion coefficient of the pellet that is the maximum expansion amount of the pellet from the pellet at the maximum shrinkage based on the thickness of the pellet at 25° C., is 0% to 7.5%, preferably 0% to 5%, more preferably 0% to 3%.

When the maximum shrinkage of the pellet exceeds 22%, in calcination when manufacturing a multilayer ceramic capacitor, estrangement of the thermal shrinkage behavior of the pellet relative to the dielectric green sheet becomes sever and the electrode continuity of the thick film conductor becomes low so that it becomes a cause of deterioration of the electrical characteristics of electronic components. The lower limit is not specifically limited, but it does not becomes lower than 15% in general in a nickel powder so 15% should be a criterion for the lower limit.

Further, when the maximum expansion amount (high temperature expansion coefficient) exceeds 7.5%, estrangement of the thermal shrinkage behavior of the pellet relative to the dielectric green sheet also becomes sever and the electrode continuity of the thick film conductor becomes low so that it becomes a cause of deterioration of the electrical characteristics of electronic components. On the other hand, it is most preferable that expansion does not occur in a temperature range of 700° C. or more. That is, the lower limit of the high temperature expansion coefficient is 0%.

(Amount of Sulfur)

In the nickel powder of the present invention, it is preferable that sulfur is included in its surface. When a surface treatment is performed where the nickel powder obtained in the crystallization process is made to contact with a treatment solution that includes a sulfur coating agent, it is possible to perform a surface treatment that modifies its surface with sulfur.

The surface of a nickel powder works like a catalyst and has an effect to promote thermal decomposition of a binder resin such as ethyl cellulose that is included in an internal electrode paste. In a debinding treatment during manufacturing a multilayer ceramic capacitor, the binder resin is decomposed from a low temperature during the temperature raising. As a result of a large amount of decomposition gas occurs accordingly, cracks may occur in an internal electrode. The effect to promote thermal decomposition of a binder resin that the surface of this nickel powder has is suppressed when sulfur exists on the surface of the nickel powder.

The amount of sulfur in a nickel powder where sulfur coat treatment is performed is preferably 1.0% by mass or less, more preferably 0.03% by mass to 0.5% by mass, even more preferably 0.04% by mass to 0.3% by mass. Here, even if the amount of sulfur exceeds 1.0% by mass, improvement in the effect to suppress the thermal decomposition of binder resin cannot be expected. On the contrary, in calcining during manufacturing a multilayer ceramic capacitor, gas that includes sulfur tends to occur and it sometimes corrodes a multilayer ceramic capacitor manufacturing device, so it is not preferable.

(Electrode Coverage Rate (Electrode Continuity))

A multilayer ceramic capacitor is constructed by a laminate where plural dielectric layers and plural internal electrode layers are laminated. This laminate is formed by calcination, so that internal electrode layer after calcination may be discontinued due to excess shrinkage of internal electrode layers or thinness of the thickness of internal electrode layer before calcination. Desired electrical characteristics cannot be obtained for this kind of multilayer ceramic capacitor of which its internal electrode layer is discontinued, so the continuity (electrode continuity) becomes an important factor to exhibit characteristics of a multilayer ceramic capacitor.

As an example of an index that evaluates the continuity of this internal electrode layer, there is an electrode coverage rate. This electrode coverage rate is indicated as a rate of an actual measurement area of a portion where the internal electrode layer is continued to a design theoretical area thereof, the actual measurement area calculated and obtained by observing the cross section of the laminate of the calcined dielectric layer and the internal electrode layer with a microscope such as an optical microscope, and analyzing the obtained observation images.

The electrode coverage rate of this internal electrode layer is preferably 80% or more, more preferably 85% or more, and even more preferably 90% or more. When the electrode coverage rate is below 80%, the continuity of the internal electrode layer deteriorates and there may be a case that desired electrical characteristics cannot be obtained for the multilayer ceramic capacitor. The upper limit of the electrode coverage rate is not specifically limited, but it is better when it is closer to 100%.

(2) Manufacturing Method of Nickel Powder

FIG. 1 shows an example of a basic manufacturing process in a manufacturing method of nickel powder with a wet method. The manufacturing method of nickel powder of the present invention uses a wet method. It comprises a crystallization process to obtain nickel powder by mixing a nickel salt solution including a water-soluble nickel salt and a metal salt of metal that is nobler than nickel, and a mixed reducing agent solution including hydrazine as a reducing agent and alkali metal hydroxide as a pH adjusting agent, or, by mixing a nickel salt solution and a reducing agent solution that includes hydrazine but does not include alkali metal hydroxide, after that, by adding alkali metal hydroxide solution including alkali metal hydroxide, to prepare a reaction solution, and then precipitating nickel by a reduction reaction.

Especially, in the manufacturing method of nickel powder of the present invention, it is characterized in crystallizing nickel powder in this crystallization process after preparing the reaction solution while additionally adding hydrazine which is a reducing agent over multiple times, or, while additionally dripping hydrazine continuously to the reaction solution.

(2-1) Crystallization Process (2-1-1) Nickel Salt Solution (a) Water-Soluble Nickel Salt The water-soluble nickel salt used in the present invention is not specifically limited as long as it is a nickel salt that is easy to dissolve in water, and one or more that is chosen among nickel chloride, nickel sulfate, and nickel nitrate can be used. Among these nickel salts, nickel chloride, nickel sulfate, or a mixture of these is preferable as it can be obtained easily at low cost.

(b) Metal Salt of Metal Nobler than Nickel

Metal that is nobler than nickel works as a nucleating agent for generating crystal nuclei in the process of nickel precipitation in the crystallization process. That is, by including metal salt of metal that is nobler than nickel to the nickel salt solution, metal ions of metal that is nobler than nickel are reduced earlier than nickel ions and become initial nuclei when reducing and precipitating nickel. When these initial nuclei experience particle growth, it is possible to obtain fine nickel powder.

As metal salt of metal that is nobler than nickel, there is water-soluble copper salt, or, water-soluble noble metal salt such as gold salt, silver salt, platinum salt, palladium salt, rhodium salt, and iridium salt. It is especially preferable to use at least any one of water-soluble copper salt, silver salt, or palladium salt.

It is possible to use copper sulfate as water-soluble copper salt, silver salt nitrate as water-soluble silver salt, and palladium (II) sodium chloride, palladium (II) ammonium chloride, palladium (II) nitrate, palladium (II) sulfate as water-soluble palladium salt, however, it is not limited to these.

As metal salt of metal that is nobler than nickel, it becomes possible to control the particle diameter of the obtained nickel powder to become finer, and to narrow its particle diameter distribution by concurrently using the copper salt and/or the noble metal salt that is illustrated above. Especially, in a complex nucleating agent comprising a mixture of metal salt of metal that is nobler than nickel comprising two or more kinds of components concurrently using copper salt and one or more noble metal salt that is chosen from among such as gold salt, silver salt, platinum salt, palladium salt, rhodium salt, and iridium salt, it becomes possible to narrow the particle diameter distribution as controlling the particle size becomes easier.

When the complex nucleating agent comprising two or more metals that are nobler than nickel, that is, comprising the copper salt together with the one or more noble metal salt is used, it is preferable that the molar ratio of the noble metal salt to the copper salt (the number of moles of noble metal salt/the number of moles of copper salt) is within a range of 0.01 to 5.0, preferably within a range of 0.02 to 1, more preferably within a range of 0.05 to 0.5. When the above molar ratio is below 0.01 or exceeds 5.0, it becomes hard to obtain an effect of concurrently using different nucleating agents and the CV value of the particle diameter of nickel powder becomes large and exceeds 20% so that the particle diameter distribution becomes wide. An especially preferable combination of a complex nucleating agent comprising copper salt and noble metal salt is a combination of copper salt and palladium salt in view of the above particle-size controllability and an effect to a narrow particle diameter distribution.

(c) Other Inclusions

It is preferable for the nickel salt solution of the present invention to include a complexing agent in addition to the above nickel salt and metal salt of metal that is nobler than nickel. The complexing agent forms a complex with nickel ion ($Ni^{2+}$) in the nickel salt solution so that, in the crystallization process, it is possible to obtain a nickel powder having a small particle diameter, narrow particle diameter distribution, less coarse particles and consolidated particles, and good sphericity.

As a complexing agent, it is preferable to use hydroxy carboxylic acid, its salt or its derivatives, or carboxylic acid, its salt or its derivatives. Specifically, tartaric acid, citric acid, malic acid, ascorbic acid, formic acid, acetic acid, pyruvic acid, and salts and derivatives thereof should be used.

In addition to the complexing agent, it is possible to include a dispersing agent in order to control particle diameter and particle diameter distribution of nickel powder. As for the dispersing agent, it is possible to use a known composition, specifically, amines such as triethanolamine ($N(C_2H_4OH)_3$), diethanolamine (alias: iminodiethanol) ($NH(C_2H_4OH)_2$), oxyethylene alkylamine, and salts and derivatives thereof, or, amino acids such as alanine ($CH_3CH(COOH)NH_2$) and glycine ($H_2NCH_2COOH$), and salts and derivatives thereof.

Further, in order to raise the solubility of each solute to be included, it is possible for the nickel salt solution of the present invention to include water-soluble organic solvent such as alcohol as solvent together with water. Regarding the water to be used for the solvent, it is preferable to use pure water in view of reducing the amount of impurities in the nickel powder that can be obtained by crystallization.

Here, the order for mixing the composition to be included in the nickel salt solution that is used in the present invention is not specifically limited.

(2-1-2) Reducing Agent Solution (a) Reducing Agent

In the present invention, hydrazine ($N_2H_4$, molecular weight: 32.05) is used as a reducing agent that is included in a reducing agent solution. Here, as hydrazine, hydrazine hydrate ($N_2H_4.H_2O$, molecular weight: 50.06) exists besides anhydrous hydrazine, and either can be used. Hydrazine is characterized in high reducing capacity, not generating by-products of reduction reaction in the reaction solution, reduced amount of impurities, and easy availability, so it is suitable as a reducing agent.

As hydrazine, it is possible to use commercially available industrial grade 60% by mass hydrazine hydrate. However, when using this kind of commercially available hydrazine and hydrazine hydrate, plural organic matter would be mixed as by-product impurities in its manufacturing process. Among these organic impurities, heterocyclic compound that is typified especially by pyrazole and its compounds that have two or more nitrogen atoms having a lone pair of electrons are known to have an effect to deteriorate the reducing capacity of hydrazine. Therefore, it is preferable to use hydrazine where organic impurities such as pyrazole and its compounds have been removed or hydrazine hydrate in order to stably proceed the reduction reaction in the crystallization process.

(b) Other Inclusions

Similar to the nickel salt solution, it is possible to include such as complexing agent and dispersing agent to the reducing agent solution of the present invention. Further, it is also possible to include water-soluble organic solvent such as alcohol together with water as solvent. Regarding the water to be used for the solvent as well, it is preferable to use pure water in view of reducing the amount of impurities in the nickel powder that can be obtained by crystallization. Here, the order for mixing the composition to be included in the reducing agent is not specifically limited.

(2-1-3) Amount of Complexing Agent

Regarding the amount of complexing agent that is included in at least either one of nickel salt solution or reducing agent solution, the value of molar ratio of the complexing agent (hydroxy carboxylic acid or carboxylic acid, or analogues of these) to nickel (the number of moles of hydroxy carboxylic acid ion or carboxylic acid ion/the number of moles of nickel) is adjusted to be within a range of 0.1 to 1.2. The formation of nickel complex proceeds as the molar ratio becomes greater, and the reaction rate becomes lower when the nickel crystallization powder precipitates and grows. However, as the reaction rate is lower, nucleus growth is promoted rather than aggregation and combination of nuclei of fine nickel particles generated initially so that the grain boundary in the nickel crystallization powder tends to be reduced and the impurities derived from chemical ingredients included in the reaction solution becomes to be hardly taken into the nickel crystallization powder. By adjusting the molar ratio to be 0.1 or more, it is possible to lower the amount of impurities in the nickel crystallization powder derived from chemical ingredients included in the reaction solution, enlarge the crystallite diameter of nickel particles, and higher the smoothness of the surface of the particles. On the other hand, although when the molar ratio exceeds 1.2, there is no big difference occurs in the effect of improving the crystallite diameter of particles comprising the nickel powder and the smoothness of the particle surface. On the contrary, due to the complexing action becoming too strong, it becomes easier to form consolidated particles in the nickel particle production process, and due to economically becoming unfavorable as the cost for chemical ingredients increases due to the increase of complexing agent. Therefore, it is not preferable to add an amount of complexing agent that exceeds the upper limit value.

(2-1-4) Alkali Metal Hydroxide

As the function (reducing capacity) of hydrazine as a reducing agent is especially improved in an alkalinity solution, alkali metal hydroxide as a pH adjusting agent is added to a reducing agent solution, or, a mixed solution of nickel salt solution and reducing agent solution. As for the pH adjusting agent, it is not specifically limited, but alkali metal hydroxide is used generally as it is easy to obtain and in view of its cost. Specifically, as for alkali metal hydroxide, there are sodium hydroxide, potassium hydroxide, or a mixture of these.

In order to sufficiently enhance the reducing capacity of hydrazine and make the crystallization reaction rate higher, the blending amount of alkali metal hydroxide is preferably adjusted so that the pH of the reaction solution becomes 9.5 or more, preferably 10.0 or more, more preferably 10.5 or more at the reaction temperature. The pH of the reaction solution is, when compared with a value at about 25° C. and 80° C. for example, the value at a high temperature of 80° C. becomes smaller. Therefore, it is preferable to determine the amount of alkali metal hydroxide considering the fluctuation of pH due to the temperature.

(2-1-5) Crystallization Procedure

The crystallization process in the manufacturing method of nickel powder of the present invention can be performed in the following procedures.

Figure 2:
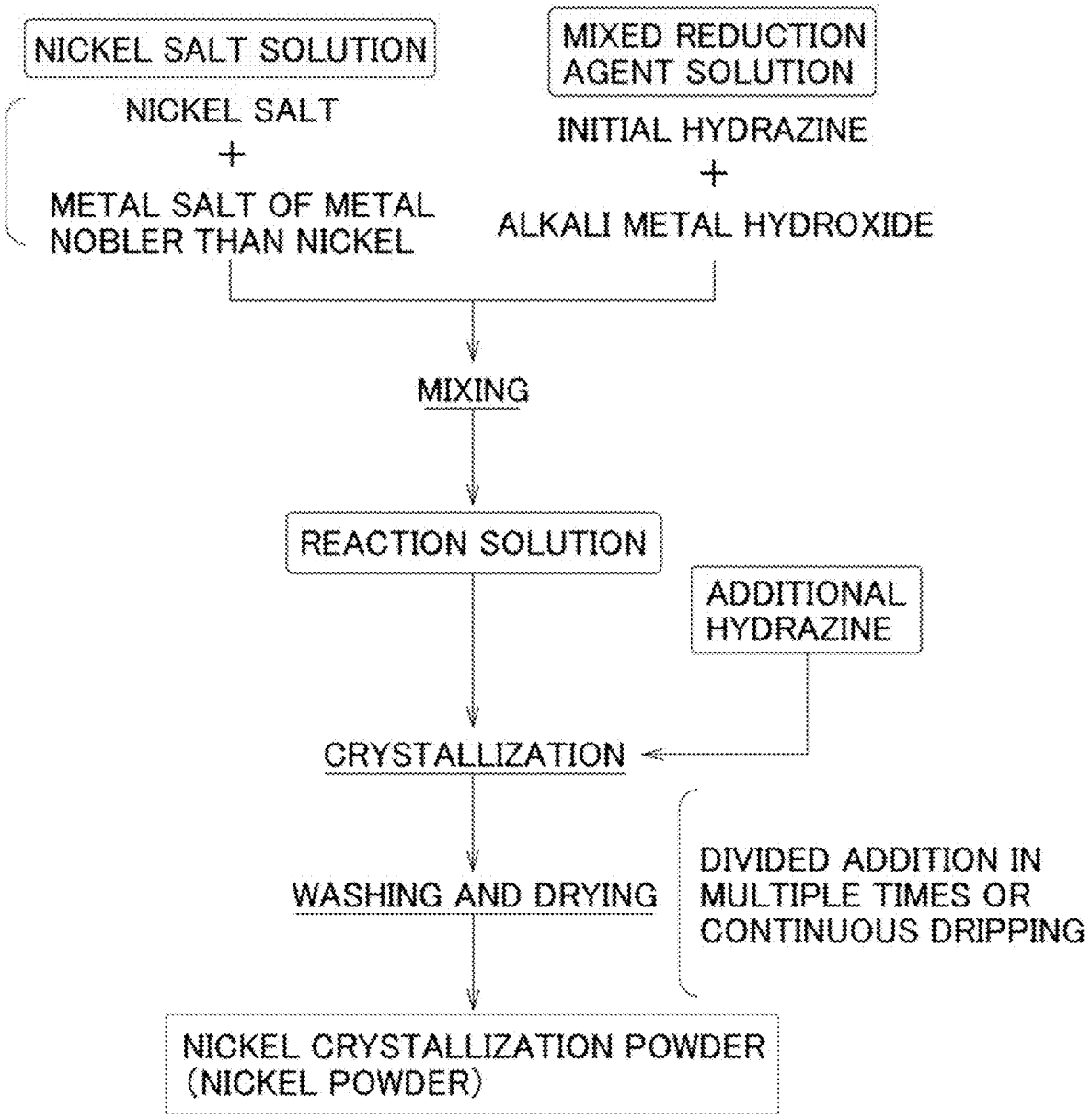
FIG. 2 is a flowchart showing an example of a crystallization process in the manufacturing method of nickel powder of the present invention.

First, an example of the first embodiment of the crystallization process is, as shown in FIG. 2, a method where a reaction solution is prepared by mixing a nickel solution and a mixed reducing agent solution including hydrazine in which alkali metal hydroxide as a pH adjusting agent has been added to obtain a reaction solution, and then hydrazine is additionally added to the reaction solution over multiple times or additionally added by continuously dripping hydrazine.

Figure 3:
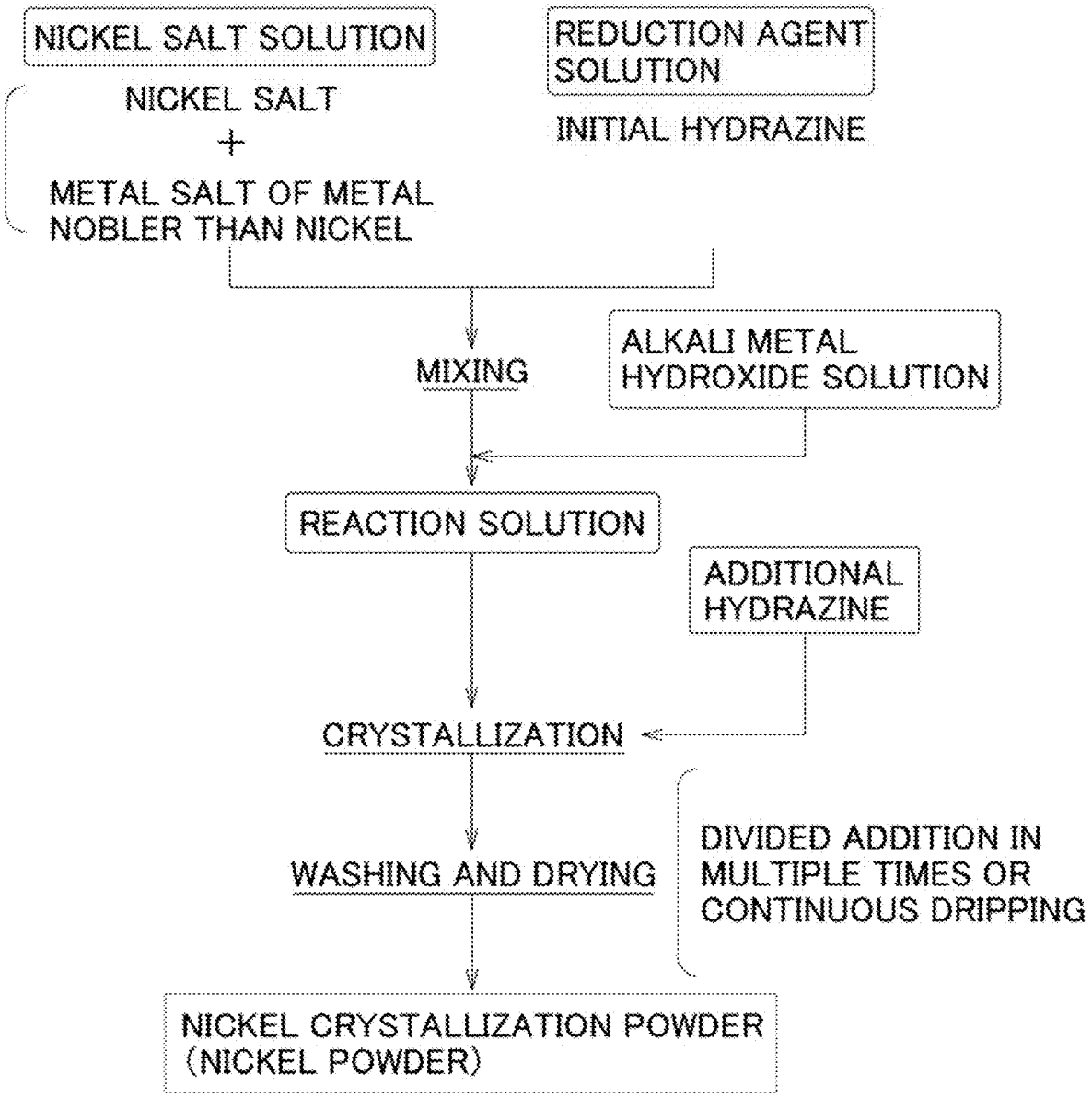
FIG. 3 is a flowchart showing another example of a crystallization process in the manufacturing method of nickel powder of the present invention.

On the other hand, one example of the second embodiment of the crystallization process is, as shown in FIG. 3, a method where a reaction solution is prepared by mixing a nickel salt solution and a reducing agent solution including hydrazine but not including alkali metal hydroxide as a pH adjusting agent, and then adding an alkali metal hydroxide solution including an alkali metal hydroxide as a pH adjusting agent thereto, to obtain a reaction solution, and, after that, hydrazine is additionally added to the reaction solution over multiple times or additionally added by continuously dripping hydrazine.

Here, in the second embodiment of the crystallization process, a reaction solution is prepared by mixing in advance a nickel salt solution including nickel salt and nucleating agent (metal salt of metal that is nobler than nickel) with a reducing agent solution that does not include alkali metal hydroxide as a pH adjusting agent to obtain slurry liquid of nickel hydrazine complex particles including metal that is nobler than nickel as a nucleating agent. Then, a reaction solution is prepared by mixing this slurry liquid with an alkali metal hydroxide solution including alkali metal hydroxide as a pH adjusting agent. The retention time after mixing the nickel salt solution and the reducing agent solution including hydrazine is enough when nickel hydrazine complex particles are formed, and it may be about two minutes or more.

In this method, in a state where nickel salt, a nucleating agent, and hydrazine as a reducing agent are uniformly mixed, an alkali metal hydroxide is added and mixed thereto to make the alkalinity of the reaction solution higher (higher pH) and raise the reducing capacity of hydrazine. In this state, nuclei are generated that enables to form a lot amount of initial nuclei uniformly, and therefore it is an effective method for making nickel crystallization powder (nickel powder) finer and making the particle diameter distribution narrower.

(2-1-6) Divided Addition of Hydrazine

In the crystallization process of the present invention, the whole amount of required hydrazine is not input to the reducing agent solution at once, but divided addition of hydrazine is performed where hydrazine is input to the reaction solution over multiple times. That is, by including part of the required hydrazine in the solution for the reducing agent as an initial hydrazine in advance, it is added to the reaction solution. And it is characterized in that the remainder of hydrazine where the amount of initial hydrazine has been removed from the whole required amount of hydrazine is additionally added to the reaction solution as additional hydrazine by (a) additionally adding to the reaction solution over multiple times, or, (b) additionally adding to the reaction solution by dripping continuously, to achieve high crystallization of nickel powder obtained with the wet method.

In the present invention, the amount of hydrazine in the reducing agent solution (the amount of initial hydrazine) is within a range of 0.05 to 1.0 when expressed in a molar ratio to nickel. The amount of initial hydrazine is preferably within a range of 0.2 to 0.7, and more preferably within a range of 0.35 to 0.6.

When the amount of initial hydrazine is below the lower limit, that is, when a molar ratio to nickel of the amount of initial hydrazine is below 0.05, the reducing capacity is too small so that it is not possible to control the initial nucleation in the reaction solution and to control the particle size, the desired average particle diameter cannot be stably obtained, and the particle diameter distribution becomes very wide, and therefore its adding effect as a reducing agent cannot be obtained. On the other hand, when the amount of initial hydrazine exceeds the upper limit, that is, when a molar ratio to nickel of the amount of initial hydrazine exceeds 1.0, the effect of high crystallization of nickel powder due to additionally including hydrazine when crystallizing nickel powder cannot be fully obtained.

On the other hand, the whole amount of hydrazine that is additionally input is expressed in a molar ratio to nickel is within a range of 1.0 to 3.2 when expressed in a molar ratio to nickel. The amount of additional hydrazine is preferably within a range of 1.5 to 2.5, more preferably within a range of 1.6 to 2.3.

When the amount of additional hydrazine is below the lower limit, that is, when a molar ratio to nickel of the amount of additional hydrazine is below 1.0, although it depends on the amount of initial hydrazine, there is a possibility that not whole amount of nickel in the reaction solution can be reduced. On the other when the amount of additional hydrazine exceeds the upper limit, that is, when the molar ratio of additional hydrazine to nickel exceeds 3.2, no further effect can be obtained and it only becomes economically unfavorable by using excessive hydrazine.

Regarding the whole amount of hydrazine (the sum of the amount of initial hydrazine and additional hydrazine) that is input in the crystallization process is preferably within a range of 2.0 to 3.25 when expressed in a molar ratio to nickel. When the whole amount of hydrazine is below the lower limit, that is, below 2.0, there may be a possibility that not whole amount of nickel in the reaction solution is reduced. On the other hand, when the whole amount of hydrazine exceeds the upper limit, that is, 3.25 or more, no further effect can be obtained and it becomes economically unfavorable by using excessive hydrazine.

When additionally inputting additional hydrazine in the reaction solution over multiple times, any number that is two or more can be employed as the number, however, it is preferable to lower the input amount of hydrazine per turn and make the input number larger as the hydrazine concentration in the reaction solution can be maintained low and high crystallization of nickel becomes easier. When the additional input of additional hydrazine over multiple times is performed by an automated system, it can be divided into several times to a few dozen times, and the effect of additional input becomes higher as the input number becomes larger. However, when the additional input is performed manually for several times, even when the number is set to be three to five times in view of complexity of the operation, the effect of high crystallization of nickel powder can be sufficiently obtained.

On the other hand, when additionally inputting additional hydrazine in the reaction solution by dripping it continuously, it is preferable to set the dripping speed of additional hydrazine to be 0.8/h to 9.6/h in a molar ratio to nickel, more preferably to be 1.0/h to 7.5/h. When the dripping speed is below 0.8/h in a molar ratio to nickel, it is not preferable as the progression of the crystallization reaction delays and the productivity deteriorates. On the other hand, when the dripping speed exceeds 9.6/h in a molar ratio to nickel, the supply rate of additional hydrazine becomes larger than the consumption rate of hydrazine in the crystallization reaction so that the hydrazine concentration rises in the reaction solution due to excessive hydrazine and it becomes difficult to obtain the effect of high crystallization.

(2-1-7) Mixing Each Solution

When mixing solutions such as a nickel salt solution, a reducing agent solution including hydrazine, an alkali metal hydroxide solution including alkali metal hydroxide as a pH adjusting agent, mixed reducing agent solution including hydrazine together with alkali metal hydroxide, and the reaction solution, it is preferable to agitate each of these solutions. By this agitation, it is possible to uniform the crystallization reaction and obtain a nickel crystallization powder (nickel powder) having a narrow particle diameter distribution. A known method can be used for an agitation method, and it is preferable to use an impeller in view of controllability and facility manufacturing cost. As for the impeller, commercially available products such as paddle blade, turbine blade, MAXBLEND, Fullzone blade can be used. It is also possible to install a baffle plate, baffle stick, etc. in the crystallization tank to improve, for example, agitating and mixing performance.

In the first embodiment of the crystallization process of the present invention, the time (mixing time) required for mixing nickel salt solution and mixed reducing agent solution including a reducing agent and a pH adjusting agent is preferably within two minutes, more preferably within one minute, even more preferably within 30 seconds. In the second embodiment of the crystallization process of the present invention, the time (mixing time) required for mixing slurry liquid of nickel hydrazine complex particles obtained after mixing nickel salt solution and reducing agent solution and alkali metal hydroxide solution is also preferably within two minutes, more preferably within one minute, even more preferably within 30 seconds. Since, when the mixing time exceeds two minutes, within the mixing time range, the uniformity of nickel hydroxide particles and nickel hydrazine complex particles and initial nucleation is impaired so that refinement of nickel powder may become difficult and there is a possibility that the particle diameter distribution becomes too wide.

(2-1-8) Crystallization Reaction

In the crystallization process of the present invention, a nickel crystallization powder (nickel powder) can be obtained as nickel precipitates due to a reduction reaction of hydrazine in a reaction solution.

The reaction of nickel (Ni) is a 2 electron reaction of formula (1), the reaction of hydrazine ($N_2H_4$) is a 4 electron reaction of formula (2). For example, when nickel chloride is used as a nickel salt and sodium hydroxide is used as an alkali metal hydroxide, the whole reduction reaction is expressed by a reaction as can be seen in formula (3) where nickel hydroxide ($Ni(OH)_2$) that is produced in the neutralization reaction of nickel salt ($NiSO_4$, $NiCl_2$, $Ni(NO_3)_2$, etc.) and sodium hydroxide is reduced by hydrazine. Stoichiometrically, as a theoretical value, 0.5 mol of hydrazine is required for 1 mol of nickel.

Here, from the reduction reaction of hydrazine of formula (2), it is understood that the reducing capacity of hydrazine becomes higher when the alkalinity is higher. An alkali metal hydroxide is used as a pH adjusting agent that makes the alkalinity higher, and it works to promote the reduction reaction of hydrazine.

[Chemical Formula 1]

$$Ni^{2+}+2e^{-}\rightarrow Ni\downarrow \text{ (2 electron reaction)} \quad (1)$$

[Chemical Formula 2]

$$N_2H_4\rightarrow N_2\uparrow+4H^{+}+4e^{-} \text{ (4 electron reaction)} \quad (2)$$

[Chemical Formula 3]

$$Ni^{2+}+X^{2-}+2NaOH+\tfrac{1}{2}N_2H_4$$

$$\rightarrow Ni(OH)_2+2Na^{+}+X^{2-}+\tfrac{1}{2}N_2H_4$$

$$\rightarrow Ni\downarrow+2Na^{+}+X^{2-}+\tfrac{1}{2}N_2\uparrow+2H_2O \quad (3)$$

($X^{2-}$:$SO_4^{2-}$, $2Cl^{-}$, $2NO_3^{-}$, etc.)

In the crystallization process, an active surface of nickel crystallization powder becomes a catalyst and promotes a self-decomposition reaction of hydrazine that is shown in the formula (4) that creates a byproduct of ammonia, and hydrazine as a reducing agent is consumed beside reduction.

[Chemical Formula 4]

$$3N_2H_4\rightarrow N_2\uparrow+4NH_3 \quad (4)$$

As can be seen, the crystallization reaction in the crystallization process is expressed by a reduction reaction by hydrazine and a self-decomposition reaction of hydrazine.

(2-1-9) Crystallization Conditions (Reaction Initiation Temperature)

In the crystallization process, the temperature of the reaction solution at the time of preparation of a reaction solution and initiation of the crystallization reaction, that is, the reaction initiation temperature is preferably set to be 60° C. to 95° C., more preferably to be 70° C. to 90° C. The crystallization reaction starts soon after the preparation of the reaction solution, that is, soon after the nickel salt solution, initial hydrazine, and alkali metal hydroxide are mixed. Therefore, the reaction initiation temperature is thought to be the temperature at the preparation of reaction solution, that is, the temperature of the solution that includes a water-soluble nickel salt, a metal salt of a metal that is nobler than nickel, hydrazine, and alkali metal hydroxide. The speed of a reduction reaction can be faster when the reaction initiation temperature is higher, however, when the temperature exceeds 95° C., it becomes difficult to control the particle size of a nickel crystallization powder and control the speed of the crystallization reaction and a problem such as the reaction solution boils over from the reaction container may arise. Further, when the reaction initiation temperature is below 60° C., the speed of the reduction reaction becomes slow so that the time required for the crystallization process prolongs and the productivity deteriorates. From these reasons, when the reaction initiation temperature is set to be within the temperature range of 60° C. to 95° C., it becomes possible to manufacture a nickel crystallization powder (nickel powder) that is easy to control the particle size and has an excellent characteristic while maintaining high productivity.

(2-1-10) Collecting Nickel Crystallization Powder

From the nickel crystallization powder slurry including nickel crystallization powder that is obtained in the crystallization process, by following a known procedure, for example, washing, solid-liquid separation, and drying, only nickel crystallization powder becomes separated. It is possible to obtain a nickel crystallization powder whose surface is modified with sulfur by adding a sulfur coating agent that is a water-soluble sulfur compound to nickel crystallization powder slurry in advance to this procedure as necessary.

Further, in the manufacturing method of nickel powder of the present invention, it is preferable to reduce coarse particles (consolidated particles) that were generated mainly in the connection of nickel particles in the forming process of nickel particles in the crystallization process by additionally performing a cracking treatment process (post-treatment process) to the nickel crystallization powder that is obtained in the crystallization process, as necessary.

In order to separate nickel crystallization powder from nickel crystallization powder slurry, solid-liquid separation is performed with known means such as a denver filter, filter press, centrifuge, and decanter, and sufficiently wash with highly pure water such as pure water having the conductivity of 1 μS/cm or less, or super pure water. Here, sufficient washing means to wash to the extent where the conductivity of the filtrate that is obtained when filtering and washing nickel crystallization powder until the conductivity becomes 10 μS/cm or less when using pure water having the conductivity of about 1 μS/cm. As can be seen, nickel crystallization powder is obtained by drying within a temperature range of 50° C. to 200° C., preferably within a range of 80° C. to 150° C. by using a widely used drying apparatus such as an air dryer, hot-air dryer, inert gas atmosphere dryer, vacuum dryer after being performed solid-liquid separation and washing.

As necessary, by adding to the nickel crystallization powder slurry a sulfur coating agent that is a water-soluble sulfur compound including either mercapto group (—SH) such as thiomalate ($HOOCCH(SH)CH_2COOH$), L-cysteine ($HSCH_2CH(NH_2)COOH$), thioglycerol ($HSCH_2CH(OH)CH_2OH$), and dithiodiglycolic acid ($HOOCH_2S—SCH_2COOH$), or disulfide group (—S—S—), it is possible to obtain a water-soluble sulfur compound whose surface is treated with sulfur.

(2-2) Cracking Process (Post-Treatment Process)

As stated above, the nickel crystallization powder obtained in the crystallization process can be used as a final product of nickel powder. However, as shown in FIG. 1, by performing a cracking treatment as necessary, it is preferable to reduce such as coarse particles and consolidated particles that were formed in the process where nickel precipitates. As a cracking treatment, it is possible to apply dry cracking methods such as spiral jet cracking treatment, counter jet mill cracking treatment, wet cracking methods such as high pressure fluid impingement cracking treatment, or other widely used cracking methods.

(3) Internal Electrode Paste

The internal electrode paste of the present invention is characterized in including nickel powder and organic solvent, the nickel powder comprised with the nickel powder of the present invention. As an organic solvent, α-terpineol, etc. is used. Further, it is possible to further include an organic binder such as binder resin. As an organic binder, ethyl cellulose resin, etc. is used.

The internal electrode paste of the present invention is used for forming an internal electrode layer in electronic components. By using the internal electrode paste of the present invention, it is possible to raise the continuity (electrode continuity) of the internal electrode in electronic components, and it is possible to prevent occurrence of short circuit defect. It is preferable that the ratio of nickel powder in the internal electrode paste is 40% by mass or more and 70% by mass or less.

(4) Electronic Components

The electronic components of the present invention comprise at least an internal electrode, and it is characterized that the internal electrode is comprised with a thick film conductor that is formed by using the internal electrode paste of the present invention. As for electronic components to which the present invention is applied, there are a multilayer ceramic capacitor (MLCC), inductor, piezoelectric element, thermistors, etc. Following is an explanation of the electronic components of the present invention with an example of a multilayer ceramic capacitor.

Figure 4:
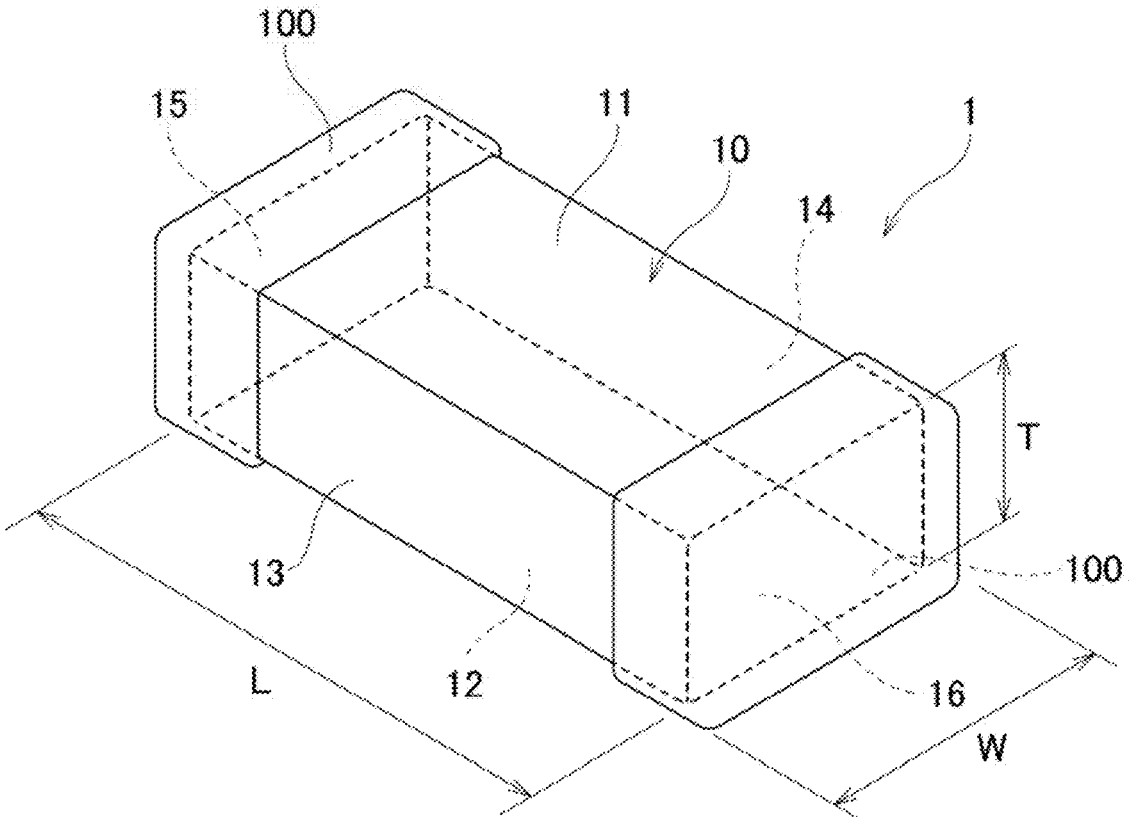
FIG. 4 is a perspective view schematically showing an example of a multilayer ceramic capacitor that is an electronic component of the present invention.
Figure 5:
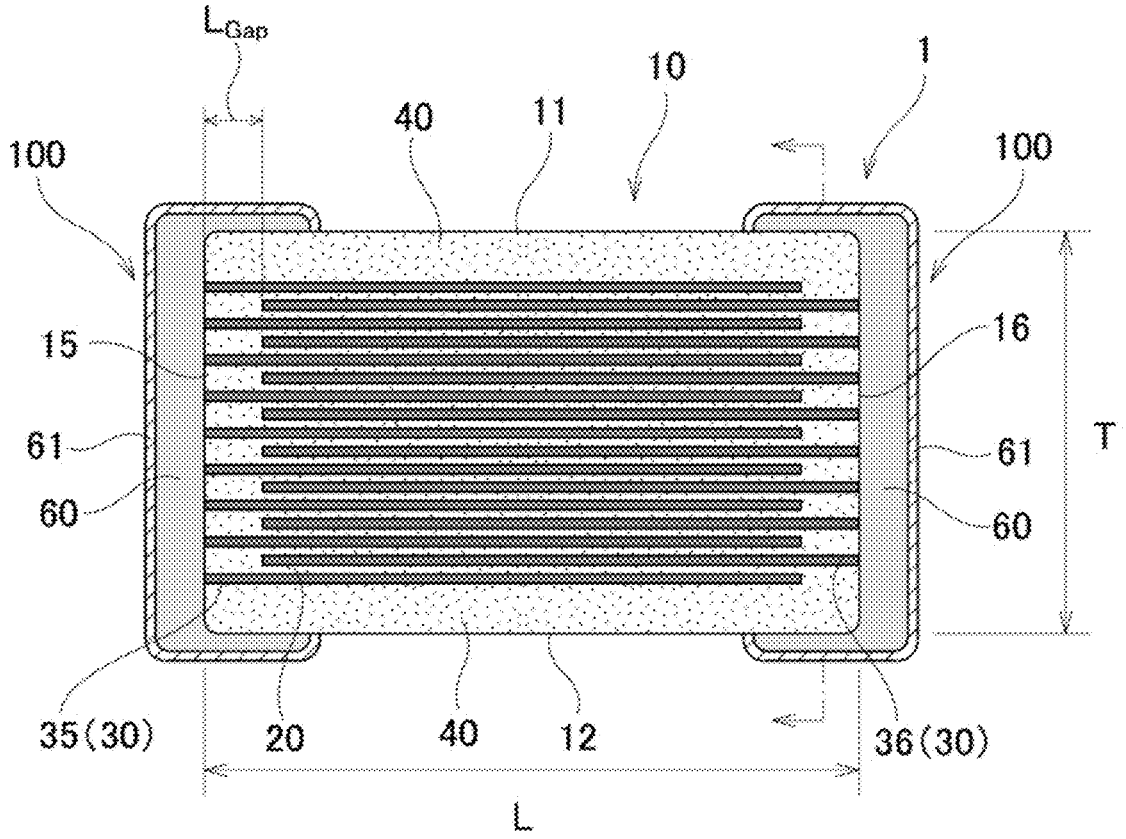
FIG. 5 is an LT cross sectional view of the multilayer ceramic capacitor shown in FIG. 4.

A multilayer ceramic capacitor comprises a laminate and an external electrode that is provided on the end surface of the laminate. FIG. 4 is a perspective view that schematically illustrates an example of a multilayer ceramic capacitor to which the present invention is applied. The multilayer ceramic capacitor 1 is constructed by providing an external electrode 100 on the end surface of laminate 10. Here, the lengthwise direction, width direction, and the stacking direction of laminate 10 are indicated as L, W, and T respectively. FIG. 5 is an LT cross sectional view including the lengthwise (L) direction and height (T) direction of the multilayer ceramic capacitor shown in FIG. 4. The laminate 10 includes laminated plural dielectric layers 20 and plural internal electrode layers 30, and includes first main surface 11 and second main surface 12 that are opposite to the stacking direction (height (T) direction), first side surface 13 and second side surface 14 that are opposite to the width (W) direction that are perpendicular to the stacking direction, and first end surface 15 and second end surface 16 that are opposite to the lengthwise (L) direction that is perpendicular to the stacking direction and the width direction. As for the laminate 10, it is preferable to be rounded at a corner where three sides of the laminate 10 intersect, and at a ridge portion where two sides of laminate 10 intersect.

As shown in the LT cross sectional view of FIG. 5, laminate 10 has laminated plural dielectric layers 20 and plural internal electrode layers 30. The plural internal electrode layers 30 is exposed at least to the first end surface 15 of laminate 10, and to plural first internal electrode layers 35 that are connected to an external electrode 100 that is provided on a first end surface 15, and at least to a second end surface 16 of laminate 10, and comprises plural second internal electrode layers 36 that are connected with the external electrode 100 that is provided to a second end surface 16.

The average thickness of the plural dielectric layers 20 is preferably 0.1 μm to 5.0 μm. Regarding material for each dielectric layer, there is ceramic material whose main component is such as barium titanate ($BaTiO_3$), calcium titanate ($CaTiO_3$), strontium titanate ($SrTiO_3$), and calcium zirconate ($CaZrO_3$). Further, it is possible to use material for each dielectric layer 20 where secondary constituents such as manganese (Mn) compound, iron (Fe) compound, chromium (Cr) compound, cobalt (Co) compound, nickel (Ni) compounds, whose amount is smaller than that of the main constituent.

Further, it is possible to provide an outer layer portion 40, formed by laminating dielectric layer 20 only, to the outside of laminated plural dielectric layers 20 and plural internal electrode layers 30. The outer layer portion 40 is positioned in the main surface side of both height directions of laminate 10 in relation to the internal electrode layer 30, and it is a dielectric layer that is positioned between each main surface and internal electrode layer 30 that is closest to the main surface. The area that is sandwiched between these outer layer portions 40 where the internal electrode layer 30 exists can be called as an internal layer portion. The thickness of the outer layer portion 40 is preferably 5 μm to 30 μm.

The number of dielectric layer that is laminated to the laminate 10 is preferably 20 to 1500. This number includes the number of dielectric layers that become the outer layer portion 40.

Regarding the dimensions of laminate 10, the length along the lengthwise (L) direction is preferably 80 μm to 3200 μm, the length along the width (W) direction is 80 μm to 2600 μm, and the length along the stacking direction (height (T) direction) is preferably 80 μm to 2600 μm.

The first internal electrode layer 35 comprises a facing portion that faces the second internal electrode layer 36 sandwiching the dielectric layer 20, and a drawer portion that is drew from the facing portion to the first end surface 15 and is exposed to the first end surface 15. The second internal electrode layer 36 comprises a facing portion that faces the facing portion of the first internal electrode layer 35 sandwiching the dielectric layer 20, and a drawer portion that is drew from the facing portion to the second end surface 16 and is exposed to the second end surface 16. Each internal electrode layer 30 is substantially rectangular when planarly viewed from the stacking direction. In each facing portion, a capacitor is formed as the internal electrode layers face via the dielectric layer.

As shown in FIG. 5, a portion that is positioned between the facing portion and the end surface and includes any one of drawer portion of either first internal electrode layer or second internal electrode layer is made to be an L gap of the laminate. The length ($L_{Gap}$) in the lengthwise direction of L gap of the laminate is preferably 5 μm to 30 μm.

The external electrode 100 is provided on the end surface (first end surface 15, second end surface 16) of laminate 10 and extends to each part of the first main surface 11, second main surface 12, first side surface 13, and second side surface 14 to cover part of each surface. The external electrode 100 is connected to the first internal electrode layer 35 at the first end surface 15, and to the second internal electrode layer 36 at the second end surface 16.

As shown in FIG. 5, the external electrode 100 has a base layer 60 and a plating layer 61 that is positioned over the base layer 60. The thickness of a portion where the thickness of base layer 60 is most thick is preferably 5 μm to 300 μm. Further, it is also possible to provide plural base layers 60.

The base layer 60 shown in FIG. 5 is a baked layer including glass and metal, and the glass of the baked layer includes elements such as silicon. Regarding the metal of the baked layer, it is preferable that it includes at least one element that is chosen from among a group of copper, nickel, silver, palladium, silver-palladium alloy, and gold. The baked layer is a layer where conductive paste including glass and metal is applied to the laminate and baked, and it is formed at the same time of calcination of the internal electrode or is formed in an individual baking process after calcination of the internal electrode.

The base layer 60 is not limited to the baked layer, and it may be comprised with a resin layer or a thin film layer. When the base layer 60 is a resin layer, it is preferable that the resin layer is a resin layer that includes conductive particles and thermosetting resin. The resin layer can be formed directly onto the laminate.

When the base layer 60 is a thin film layer, it is preferable that the thin film layer is formed by a thin film forming method such as sputtering and a vapor deposition method, and it is a layer where metal particles have been deposited, and its thickness is 1 μm or less.

Regarding a plating layer 61, it is preferable to include at least one element that is chosen from among a group of copper, nickel, tin, silver, palladium, silver-palladium alloy, and gold. The plating layer may be plural layers. Preferably, it is a two-layer structure of nickel plating layer and tin plating layer. The nickel plating layer can prevent the base layer from erosion due to solder when implementing electronic components. The tin plating layer improves the wettability of solder when implementing electronic components and makes implementation of electronic components easy. It is preferable that the thickness of the plating layer per layer is 5 μm to 50 μm.

The external electrode may not comprise a base layer, and it is also possible to form it by forming a plating layer that is directly connected to the internal electrode layer directly on the laminate. In this case, it is also possible to provide a catalyst on a laminate as a preprocessing and form a plating layer on this catalyst. In this case, it is preferable that the plating layer includes a first plating layer and a second plating layer that is provided on the first plating layer. It is preferable that the first plating layer and the second plating layer include at least one kind of metal that is chosen from among a group of copper, nickel, tin, lead, gold, silver, palladium, bismuth, and zinc, or plating of alloy including these metals. Since the electronic components of the present invention uses nickel as metal that forms the internal electrode layer, it is preferable to use copper that has good bondability with nickel as the first plating layer. Further, it is preferable to use zin and gold having good solder wettability as the second plating layer. As for the first plating layer, it is preferable to use nickel having solder barrier capacity.

As can be seen, the plating layer can be formed with a single plating layer, and it can be formed on the first plating layer while making the second plating layer as the outermost layer, and it is also possible to provide other plating layer on the second plating layer. In either case, the thickness of a plating layer per layer is preferably 1 μm to 50 μm. It is also preferable that the plating layer does not include glass. The metal ratio per unit volume of the plating layer is preferably 99 volume % or more. The plating layer is preferably in the shape of a pillar as grain was grown along its thickness direction.

In the multilayer ceramic capacitor of the present invention, internal electrode layer 30 (first internal electrode layer 35 and second internal electrode layer 36) is comprised with a thick film conductor that is formed by using the internal electrode paste of the present invention including the nickel powder of the present invention. That is, any internal electrode layer 30 is a layer that includes nickel. The internal electrode layer 30 may include, besides nickel, other kinds of metal and dielectric particles that are the same composition system as ceramic that is included in the dielectric layer.

The number of internal electrode layer 30 that is laminated on laminate 10 is preferably 2 to 1000. Further, the average thickness of the plural internal electrode layers 30 is preferably 0.1 μm to 3 μm.

The electronic components of the present invention can be used as an electronic component that is built in the substrate, and it can also be used as an electronic component that is implemented on the surface of the substrate.

EXAMPLE

The present invention will be further specifically explained as follows with examples, however, the present invention is not limited by the following examples.

<Evaluation Method>

In the examples and comparative examples, regarding the obtained nickel powder, measurement of the amount of impurities (nitrogen (N), sodium (Na)), the amount of sulfur, crystallite diameter, average particle diameter (Mn), CV value of particle diameter, and thermal mechanical analysis (TMA) was performed by the following methods.

(The Amount of Nitrogen, Sodium, and Sulfur)

Regarding the obtained nickel powder, the amount of nitrogen of impurities that is thought to be derived from hydrazine as a reducing agent, the amount of sodium of impurities that is derived from sodium hydroxide, and the amount of sulfur were measured. As for nitrogen, a nitrogen analyzer (manufactured by LECO Corporation, TC436) using an inert gas fusion method was used. As for sodium, an atomic absorption spectrometer (manufactured by Hitachi High-Technologies Corporation, Z-5310) was used. As for sulfur, a sulfur analyzer (manufactured by LECO Corporation, CS600) using a combustion method was used.

(Crystallite Diameter)

Regarding the obtained nickel powder, its crystallite diameter was calculated using a known method of Wilson method from the diffraction pattern that was obtained by an X-ray diffraction device (manufactured by Spectris Co., Ltd.; X'Pert PRO).

(Average Particle Diameter and CV Value of Particle Diameter)

The obtained nickel powder was observed with a scanning electron microscope (SEM: manufactured by JEOL Ltd., JSM-7100F, magnification rate: 5000 to 80000), and the average particle diameter (Mn) which was obtained by the number average and its standard deviation (σ) were calculated based on the results of analysis of observation images (SEM images). Then, CV value which is a value (%) obtained by dividing a standard deviation of the average particle diameter by an average particle diameter [average particle diameter a standard deviation (σ)/average particle diameter (Mn))×100] was obtained.

(Thermal Mechanical Analysis (TMA) Measurement)

About 0.3 g of the obtained nickel powder was weighed and filled in a metal mold having a cylindrical hole having an inner diameter of 5 mm, and it was pressed at 100 MPa by a press to form a pellet having a diameter of 5 mm and height of 3 mm to 4 mm. Regarding this pellet, the thermal shrinkage behavior when heated was measured by using a thermal mechanical analyzer (TMA) (manufactured by BRUKER Corporation, TMA4000SA). As for measurement conditions, the load that was applied to the pellet was 10 mN, and the raising rate of temperature from 25° C. to 1200° C. was 10° C./min in inert atmosphere where nitrogen gas was continuously flew at 1000 ml/min.

From the thermal shrinkage behavior of the pellet that was obtained by the TMA measurement, the maximum shrinkage temperature (the temperature where the thermal shrinkage becomes maximum when heated from 25° C. to 1200° C. based on the thickness of the pellet at 25° C.), the maximum shrinkage (the maximum value of thermal shrinkage at the maximum shrinkage temperature based on the thickness of the pellet at 25° C.), and the high temperature expansion coefficient (the maximum expansion amount of the pellet in a temperature range from the maximum shrinkage temperature or more to 1200° C. or less based on the thickness of the pellet at 25° C.) were obtained respectively.

(Electrode Coverage Rate (Electrode Continuity))

Polyvinyl butyral binder resin, plasticizer and ethanol as an organic solvent were added to barium titanate powder as ceramic raw material, and it was wet-blended with a ball mill to prepare ceramic slurry, and a dielectric green sheet was obtained by sheet molding the obtained ceramic slurry with a rip method. By screen printing internal electrode paste including the obtained nickel powder on the dielectric green sheet, a dielectric sheet comprising a thick film conductor was obtained. To obtain a laminated sheet, the dielectric sheet was laminated so that the side to be pulled out of the thick film conductor becomes alternate. The laminated sheet was pressured and molded, and it was divided by dicing to obtain a chip. After heating the chip in a nitrogen atmosphere and removing the binder resin (debinding treatment), it was calcined in a reducing atmosphere including hydrogen, nitrogen, and water vapor gas to obtain a sintered laminate. This laminate was used for the measurement of the electrode coverage rate.

Regarding the electrode coverage rate of the internal electrode layer of the obtained laminate, it was obtained about five samples each, by cutting the calcined laminate in the center in the stacking direction to observe the cutting plane with an optical microscope to analyze images, and calculate the area ratio of an actual measurement area in relation to the theoretical area of the internal electrode layer to obtain its average value. When the electrode coverage rate is 80% or more, it was determined that the electrode continuity was good (I). When the electrode coverage rate was below 80%, it was determined that the electrode continuity was not good (X).

Regarding each reagent used in the examples and comparative examples, reagents manufactured by Wako Pure Chemical Industries Co., Ltd. were used unless specifically mentioned.

Example 1

[Preparation of Nickel Salt Solution]

448 g of nickel sulfate hexahydrate ($NiSO_4.6H_2O$, molecular weight: 262.85) as a nickel salt, 1.97 mg of copper sulfate pentahydrate ($CuSO_4.5H_2O$, molecular weight: 249.7) as a metal salt of a metal that is nobler than nickel, and 0.134 mg of palladium (II) chloride ammonium (also called ammonium tetrachloropalladate (II)), and 228 g of trisodium citrate dihydrate ($Na_3(C_3H_5O(COO)_3).2H_2O$), molecular weight: 294.1) as a complexing agent were dissolved in 1150 mL of pure water to prepare a nickel salt solution that is an aqueous solution including a nucleating agent that is a metal salt of metal that is nobler than nickel and a complexing agent.

Here, in the nickel salt solution, the amount of copper (Cu) and palladium (Pd) to nickel were 5.0 mass ppm and 0.5 mass ppm respectively (4.63 mol ppm and 0.28 mol ppm respectively), and the molar ratio of trisoclium citrate to nickel was 0.45.

[Preparation of Mixed Reducing Agent Solution]

As a reducing agent, 69 g of 60% hydrazine hydrate ($N_2H_4.H_2O$, molecular weight: 50.06) that was purified by removing organic impurities such as pyrazole was dissolved in 1250 ml of pure water together with 184 g of sodium hydroxide (NaOH, molecular weight: 40.0) as an alkali metal hydroxide that is a pH adjusting agent, and 6 g of triethanolamine ($N(C_2H_4OH)_3$, molecular weight: 149.19) as a dispersing agent, to prepare a mixed reducing agent solution that is an aqueous solution including hydrazine as well as sodium hydroxide and alkanolamine compound.

Here, the molar ratio of the amount of hydrazine (the amount of initial hydrazine) included in the mixed reducing agent solution to nickel was 0.49.

[Crystallization Process]

After heating the nickel salt solution and mixed reducing agent solution until each solution temperature reached 85° C., these two solutions were stirred and mixed to prepare a reaction solution and initiate the crystallization reaction. Due to the heat generated while stirring and mixing the nickel salt solution and mixed reducing agent solution each having a solution temperature of 85° C., the temperature of the reaction solution rose to 88° C., so that the reaction initiation temperature was 88° C. After about 2 to 3 minutes from the reaction initiation (stirring and mixing of the two solutions), the color of the reaction solution changed from yellowish green to gray due to the function of the nucleating agent. While further stirring, a reduction reaction was performed by dripping 321 g of purified 60% hydrazine hydrate (additional hydrazine) as additional hydrazine at a speed of 4.6 g/min for 68 minutes from after the passage of 10 minutes after the initiation of reaction to obtain a nickel crystallization powder. The supernatant liquid of the reaction solution after the completion of the reduction reaction was transparent, and it was confirmed that the entire nickel component in the reaction solution had been reduced to metal nickel.

Here, the amount of additional hydrazine to nickel in a molar ratio was 2.19, and when the dripping speed of additional hydrazine was expressed in a molar ratio to nickel, it was 1.94/h. Further, the total amount of hydrazine (sum of the amount of initial hydrazine and the amount of additional hydrazine) added in the crystallization process in a molar ratio to nickel was 2.68.

Each chemical ingredient used in the crystallization process and crystallization conditions are all shown together in Table 1.

The reaction solution including the obtained nickel crystallization powder was slurry (nickel crystallization powder slurry), and thiomalate (alias: mercaptosuccinic acid) ($HOOCCH(SH)CH_2COOH$, molecular weight:150.15) aqueous solution as a sulfur coating agent (S coating agent) was added to this nickel crystallization powder slurry and thus surface treatment was performed to the nickel crystallization powder. After performing the surface treatment, filtering and washing was performed with pure water having a conductivity of 1 μS/cm until the conductivity of the filtrate that was filtered from the nickel crystallization powder slurry became 10 μS/cm or less to separate solid and liquid, and dried in a vacuum drier where the temperature was set to be 150° C. to obtain nickel crystallization powder (nickel powder) having its surface treated with sulfur (S).

[Cracking Treatment Process (Post-Treatment Process)]

Cracking process was performed following the crystallization process to reduce the consolidated particles formed in the nickel crystallization powder mainly by nickel particles combining with each other during the crystallization reaction. Specifically, spiral jet cracking treatment that is a dry cracking method was performed on the nickel crystallization powder obtained in the crystallization process to obtain the nickel powder of Example 1 having a uniform particle size and almost spherical shape.

[Evaluation of Nickel Powder]

Figure 6:
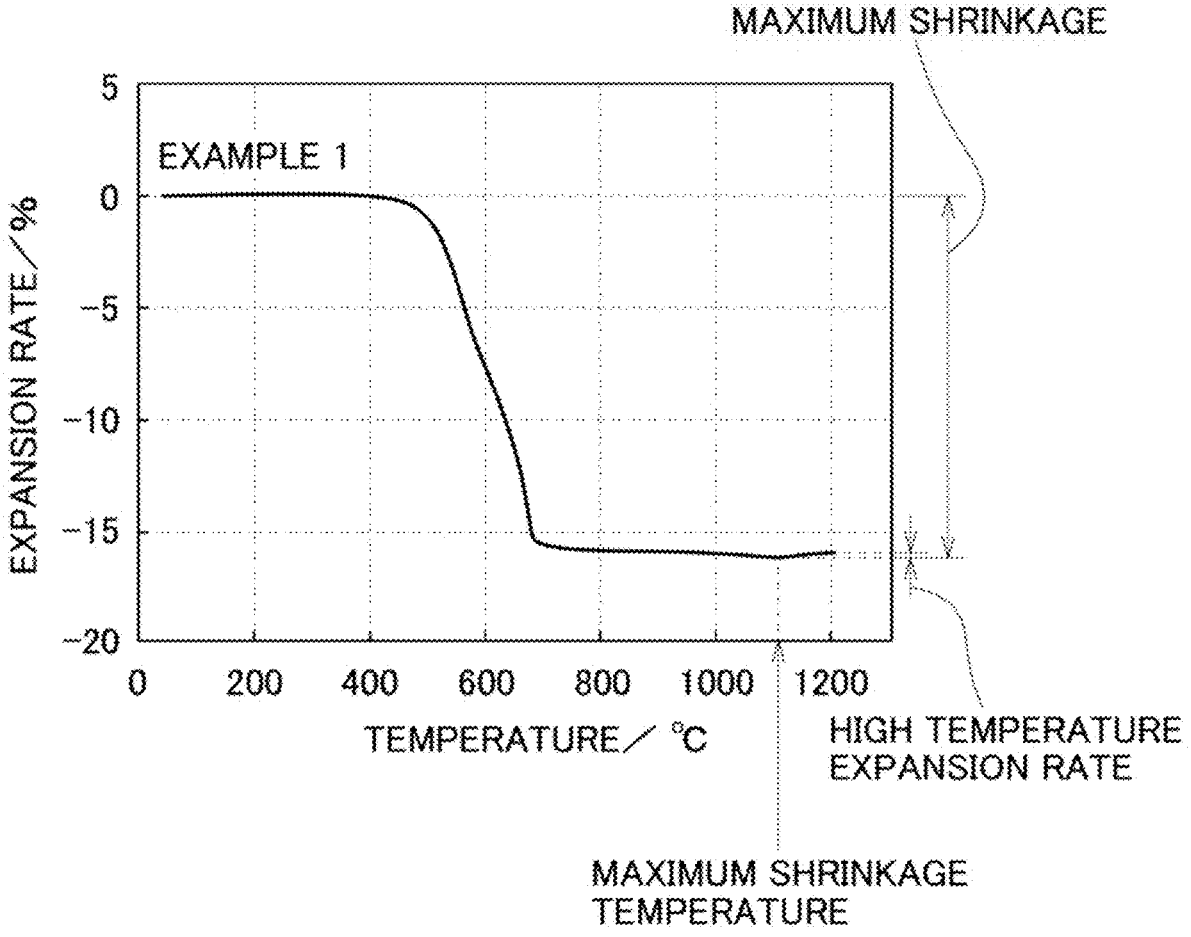
FIG. 6 is a graph of thermal shrinkage behavior obtained by thermal mechanical analysis (TMA) measurement of a nickel powder recited in Example 1 of the present invention.

Regarding the obtained nickel powder, the amount of the impurities (nitrogen, sodium), the amount of sulfur, crystallite diameter, average particle diameter, and the CV value were obtained. Further, TMA measurement was performed on the laminate manufactured by using the obtained nickel powder to obtain the maximum shrinkage temperature, the maximum shrinkage, and high temperature expansion coefficient from its thermal shrinkage behavior. These measurement results are shown in Table 2. Further, a graph regarding the thermal shrinkage behavior obtained by the TMA measurement in relation to the compact using the nickel powder of Example 1 is shown in FIG. 6.

Example 2

After heating the nickel salt solution and the mixed reducing agent solution until each solution temperature reached 80° C., the two solutions were stirred and mixed to prepare a reaction solution. The reaction initiation temperature of the reduction reaction was set to be 83° C., and 276 g of 60% hydrazine hydrate (additional hydrazine) was dripped to the reaction solution for 30 minutes to the reaction solution at a speed of 9.2 g/min from after the passage of 10 minutes after the initiation of reaction. Other conditions were set to be the same as that of Example 1 to make nickel powder of Example 2 having a uniform particle size and almost spherical shape and to evaluate.

Figure 7:
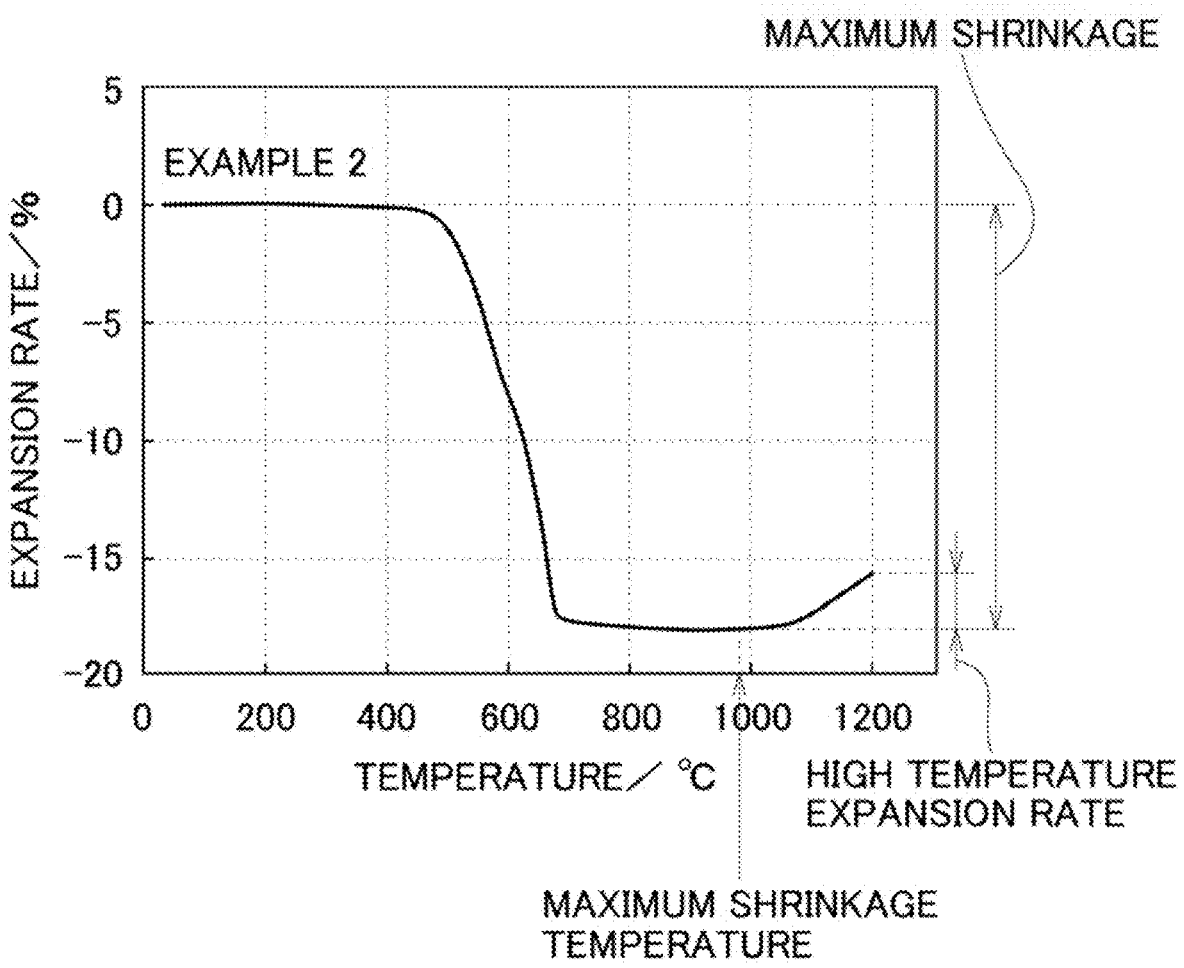
FIG. 7 is a graph of thermal shrinkage behavior obtained by thermal mechanical analysis (TMA) measurement of a nickel powder recited in Example 2 of the present invention.

The molar ratio of the amount of the additional hydrazine to nickel was 1.94, and the dripping speed of the additional hydrazine indicated as a molar ratio to nickel was 3.88/h. Further, the molar ratio of the total amount of hydrazine (the sum of the amount of initial hydrazine and the amount of additional hydrazine) added in the crystallization process to nickel was 2.43. FIG. 7 shows a graph of thermal shrinkage behavior obtained by the TMA measurement regarding the compact using the nickel powder of Example 2.

Example 3

In the nickel salt solution, the amount of copper and palladium was set to be 5.0 mass ppm and 3.0 mass ppm respectively (4.63 mol ppm and 1.68 mol ppm respectively) to nickel. After heating the nickel salt solution and the mixed reducing agent solution until the solution temperature reached 80° C., the two solutions were stirred and mixed to prepare a reaction solution. The temperature on the initiation of the reduction reaction was set to be 83° C. 242 g of 60% hydrazine hydrate (additional hydrazine) was added to the reaction solution at 4.6 g/min for 53 minutes from after the passage of 10 minutes after the initiation of reaction to perform reduction reaction. Other conditions were set to be the same as that of Example 1 to make nickel powder of Example 3 having a uniform particle size and almost spherical shape and to evaluate.

The molar ratio to nickel of the amount of additional hydrazine was 1.70, and the dripping speed of the additional hydrazine expressed as a molar ratio to nickel was 1.93/h. Further, the molar ratio to nickel of the total amount of hydrazine added in the crystallization process was 2.19.

Example 4

In the nickel salt solution, the amount of copper and palladium was set to be 20 mass ppm and 8.0 mass ppm respectively (18.52 mol ppm and 4.48 mol ppm respectively) to nickel. After heating the nickel salt solution and the mixed reducing agent solution until the solution temperature reached 80° C., the two solutions were stirred and mixed to prepare a reaction solution. The temperature on the initiation of the reduction reaction was set to be 83° C. 207 g of 60% hydrazine hydrate (additional hydrazine) was added to the reaction solution at 9.0 g/min for 23 minutes from after the passage of 10 minutes after the initiation of reaction to perform reduction reaction. Other conditions were set to be the same as that of Example 1 to make nickel powder of Example 4 having a uniform particle size and almost spherical shape and to evaluate.

The molar ratio to nickel of the amount of additional hydrazine was 1.46, and the dripping speed of the additional hydrazine expressed as a molar ratio to nickel was 3.80/h. Further, the molar ratio to nickel of the total amount of hydrazine added in the crystallization process was 1.94.

Example 5

In the nickel salt solution, the amount of copper and palladium was set to be 2.0 mass ppm and 0.2 mass ppm respectively (1.85 mol ppm and 0.11 mol ppm respectively) to nickel. After heating the nickel salt solution and the mixed reducing agent solution until the solution temperature reached 70° C., the two solutions were stirred and mixed to prepare a reaction solution. The temperature on the initiation of the reduction reaction was set to be 73° C. 276 g of 60% hydrazine hydrate (additional hydrazine) was added to the reaction solution at 4.6 g/min for 60 minutes from after the passage of 25 minutes after the initiation of reaction to perform reduction reaction. Other conditions were set to be the same as that of Example 1 to make nickel powder of Example 5 having a uniform particle size and almost spherical shape and to evaluate.

The molar ratio to nickel of the amount of additional hydrazine was 1.94, and the dripping speed of the additional hydrazine expressed as a molar ratio to nickel, it was 1.94/h. Further, the molar ratio to nickel of the total amount of hydrazine added in the crystallization process was 2.43.

Example 6

In the nickel salt solution, only 0.456 mg of palladium (II) ammonium chloride was added as a metal salt of a metal nobler than nickel. The amount of palladium was set to be 1.7 mass ppm (0.95 mol ppm) to nickel. A reduction reaction was performed by adding 60% hydrazine hydrate (additional hydrazine) to the reaction solution from after the passage of 30 minutes after the initiation of reaction once in 10 minutes for 69 g (0.49 when expressed in a molar ratio to nickel) per turn for four times (30 min, 40 min, 50 min, 60 min). The reduction reaction was terminated after 70 minutes from the initiation of reaction. Other conditions were set to be the same as that of Example 5 to make nickel powder of Example 6 having a uniform particle size and almost spherical shape and to evaluate.

The molar ratio to nickel of the amount of additional hydrazine was 1.94. Further, the molar ratio to nickel of the total amount of hydrazine added in the crystallization process was 1.94.

Example 7

A reduction reaction was performed by adding 60% hydrazine hydrate (additional hydrazine) to the reaction solution from after the passage of 30 minutes after the initiation of reaction once in 10 minutes for 69 g (0.49 when expressed in a molar ratio to nickel) per turn for four times (30 min, 40 min, 50 min, 60 min). The reduction reaction was terminated after 70 minutes from the initiation of reaction. Other conditions were set to be the same as that of Example 5 to make nickel powder of Example 7 having a uniform particle size and almost spherical shape and to evaluate.

The molar ratio to nickel of the amount of additional hydrazine was 1.94. Further, the molar ratio to nickel of the total amount of hydrazine added in the crystallization process was 1.94.

Example 8

6 g of triethanolamine as a dispersing agent and 800 mL of pure water were added to 69 g of 60% hydrazine hydrate that was purified by removing organic impurities such as pyrazole to prepare a reducing agent solution that is an aqueous solution including hydrazine and alkanolamine compound. Then, 184 g of sodium hydroxide was dissolved in 450 mL of pure water to prepare an alkali metal hydroxide solution that is an aqueous solution including sodium hydroxide. After heating the nickel salt solution and reducing agent solution until each solution temperature reached 85° C., the two solutions were stirred and mixed for one minute and maintained for about three minutes, then, the alkali metal aqueous solution having a pre-set solution temperature of 85° C. was added to obtain a reaction solution. 258 g of 60% hydrazine hydrate (additional hydrazine) was added to the reaction solution at 9.2 g/min for 28 minutes from after the passage of 10 minutes after the initiation of reaction. Other conditions were set to be the same as that of Example 2 to make nickel powder of Example 8 having a uniform particle size and almost spherical shape and to evaluate.

Figure 8:
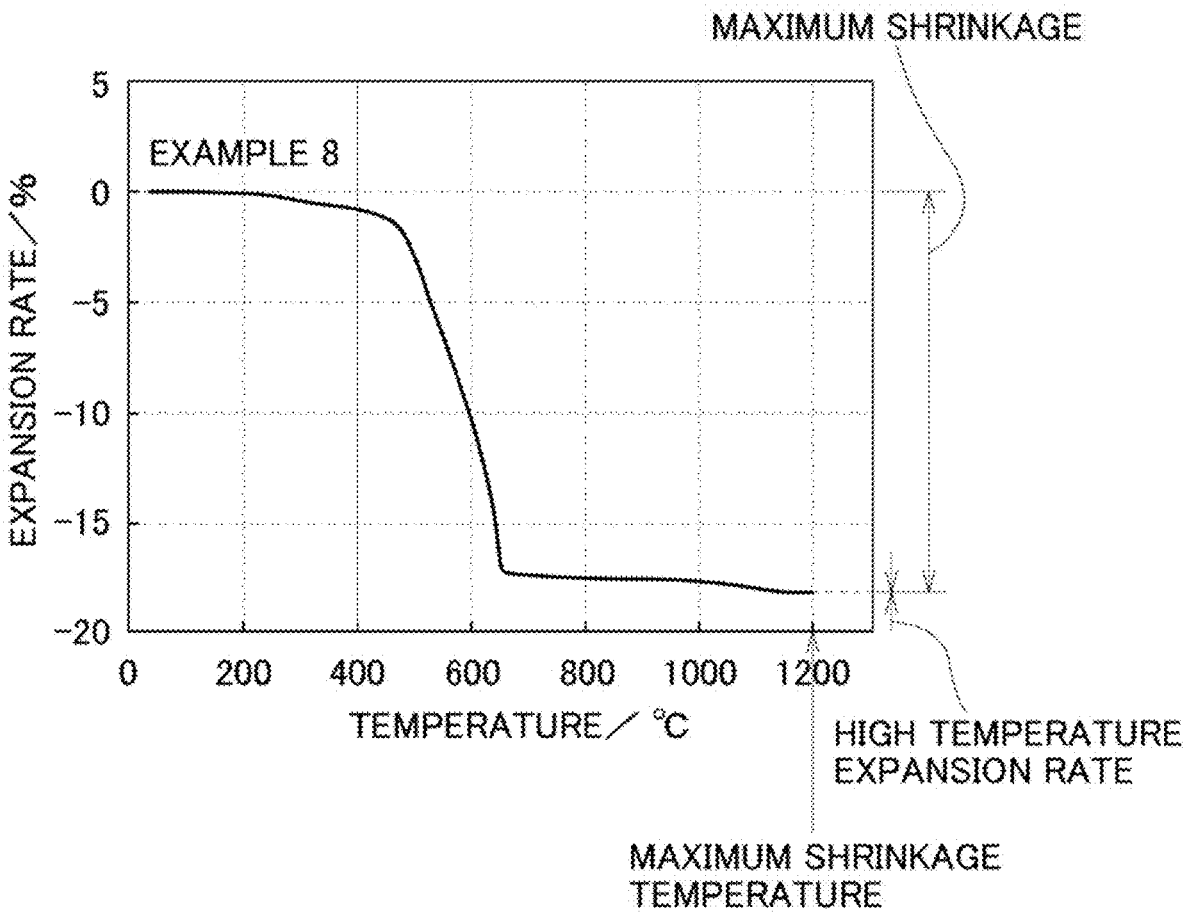
FIG. 8 is a graph of thermal shrinkage behavior obtained by thermal mechanical analysis (TMA) measurement of a nickel powder recited in Example 8 of the present invention.

The molar ratio to nickel of the amount of hydrazine that is included in the reducing agent solution was 0.49. The molar ratio to nickel of the amount of additional hydrazine was 1.81. Further, the molar ratio to nickel of the total amount of hydrazine added in the crystallization process (the sum of the amount of initial hydrazine and the amount of additional hydrazine) was 2.30. FIG. 8 shows a graph of thermal shrinkage behavior obtained by TMA measurement regarding a compact using the nickel powder of Example 8.

Comparative Example 1

A reaction solution was prepared by mixing a nickel salt solution and reducing agent solution without adding additional hydrazine and terminated the reduction reaction. The amount of trisodium citrate dehydrate was set to be 55.7 mg (a molar ratio to nickel was 0.11). In the nickel salt solution, the amount of copper and palladium was set to be 2.0 mass ppm and 0.2 mass ppm respectively (1.85 mol ppm and 0.11 mol ppm respectively) to nickel. After heating the nickel salt solution and the mixed reducing agent solution until each solution temperature reached 55° C., the two solutions were stirred and mixed to prepare a reaction solution. The temperature on the initiation of the reduction reaction was set to be 60° C. The reduction reaction was terminated after 40 minutes from the initiation of reaction. Other conditions were set to be the same as that of Example 1 to make nickel powder of Comparative Example 1 having a uniform particle size and almost spherical shape and to evaluate.

Figure 9:
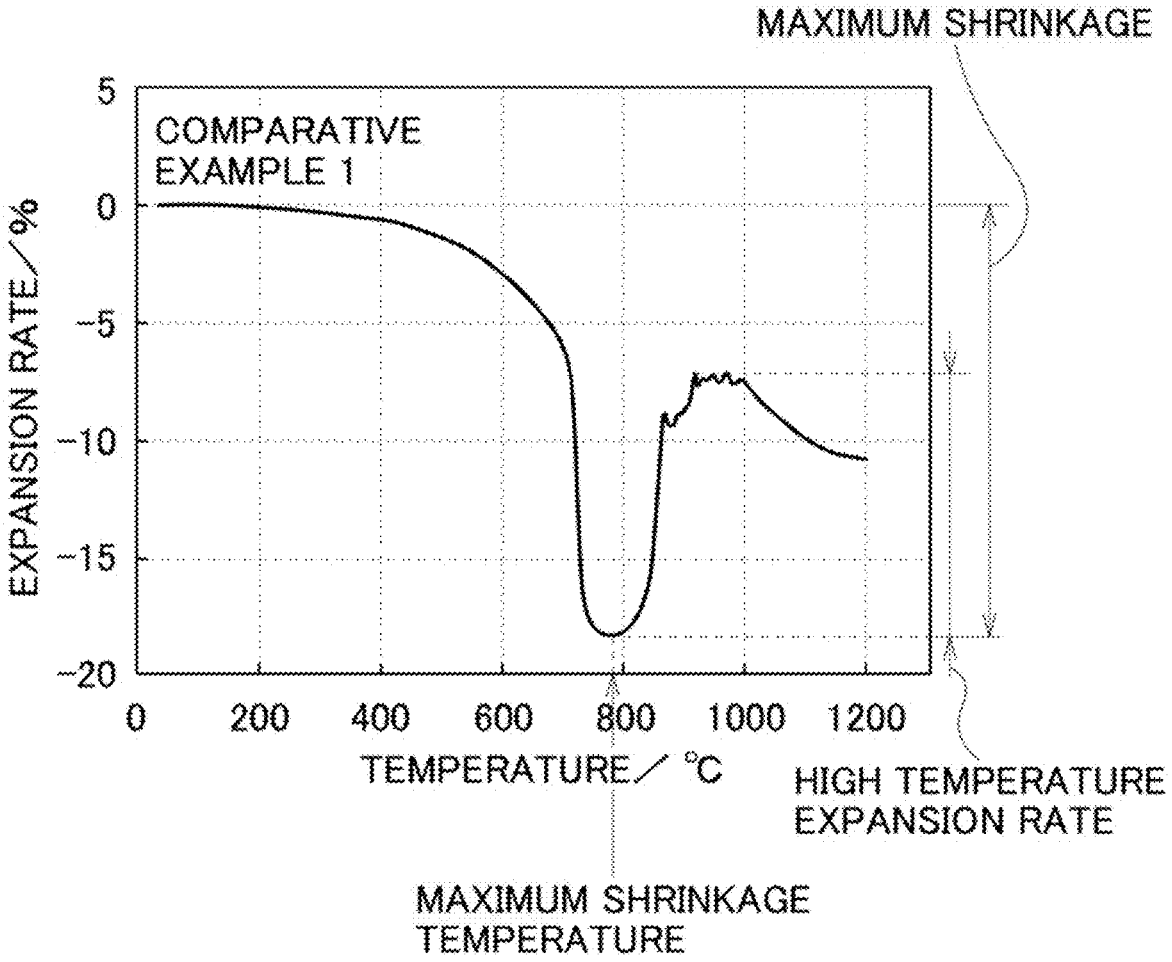
FIG. 9 is a graph of thermal shrinkage behavior obtained by thermal mechanical analysis (TMA) measurement of a nickel powder recited in Comparative Example 1.

The molar ratio to nickel of the total amount of hydrazine (the amount of initial hydrazine only) added in the crystallization process was 2.43. FIG. 9 shows a graph of thermal shrinkage behavior obtained by TMA measurement regarding a compact using the nickel powder of Comparative Example 1.

Comparative Example 2

A reaction solution was prepared by mixing a nickel salt solution and reducing agent solution without adding additional hydrazine and terminated the reduction reaction. After heating the nickel salt solution and the mixed reducing agent solution until each solution temperature reached 70° C., the two solutions were stirred and mixed to prepare a reaction solution. The temperature on the initiation of the reduction reaction was set to be 74° C. The reduction reaction was terminated after 25 minutes from the initiation of reaction. Other conditions were set to be the same as that of Example 1 to make nickel powder of Comparative Example 2 having a uniform particle size and almost spherical shape and to evaluate.

The molar ratio to nickel of the total amount of hydrazine (the amount of initial hydrazine only) added in the crystallization process was 2.18.

Comparative Example 3

A reaction solution was prepared by mixing a nickel salt solution and reducing agent solution without adding additional hydrazine and terminated the reduction reaction. After heating the nickel salt solution and the mixed reducing agent solution until each solution temperature reached 80° C., the two solutions were stirred and mixed to prepare a reaction solution. The temperature on the initiation of the reduction reaction was set to be 84° C. The reduction reaction was terminated after 15 minutes from the initiation of reaction. Other conditions were set to be the same as that of Example 1 to make nickel powder of Comparative Example 3 having a uniform particle size and almost spherical shape and to evaluate.

Figure 10:
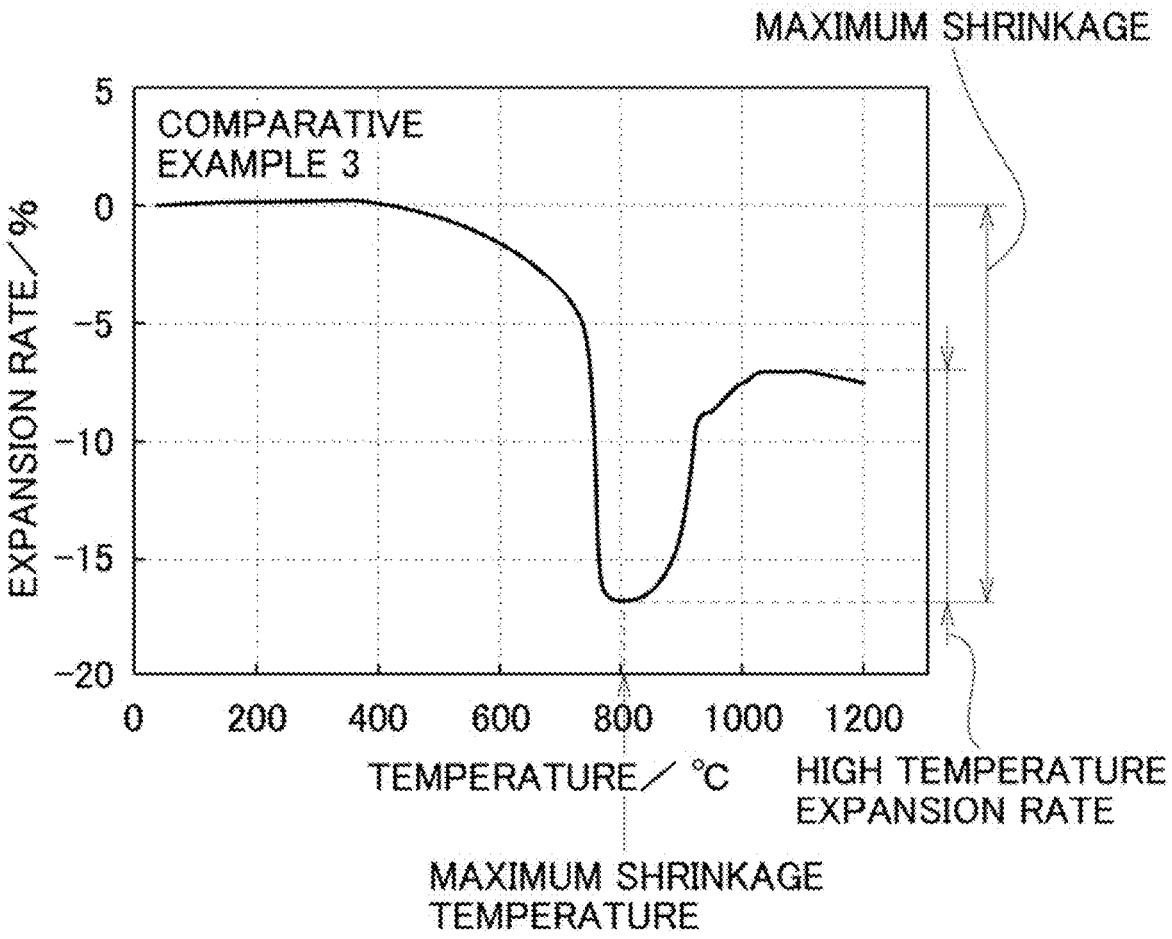
FIG. 10 is a graph of thermal shrinkage behavior obtained by thermal mechanical analysis (TMA) measurement of a nickel powder recited in Comparative Example 3.

The molar ratio to nickel of the total amount of hydrazine (the amount of initial hydrazine only) added in the crystallization process was 2.43. FIG. 10 shows a graph of thermal shrinkage behavior obtained by TMA measurement regarding a compact using a nickel powder of Comparative Example 3.

TABLE 1

| | Nickel Salt solution | | | | Additional Hydrazine | | |
|---|---|---|---|---|---|---|---|
| | Metal salt of metal that is nobler than Ni (Mass ppm to Ni) | Complexing agent Citric acid Trisodium (Molar ratio to Ni) | Reducing Agent Solution Initial hydrazine (Molar ratio to Ni) | Reaction Solution Reaction Initiation Temperature (° C.) | Addition | Method of Addition | Conditions for Addition of Hydrazine Dripping Speed (molar ratio/h to Ni), or Input Amount per Turn (molar ratio to Ni)/ Additional Amount (molar ratio to Ni) |
| Example 1 | Cu: 5.0 Pd: 0.5 | 0.45 | 0.49 | 88 | Yes | Continuous | Dripping speed: 1.94/h/additional amount: 2.19 |
| Example 2 | Cu: 5.0 Pd: 0.5 | 0.45 | 0.49 | 83 | Yes | Continuous | Dripping speed: 3.88/h/additional amount: 1.94 |
| Example 3 | Cu: 5.0 Pd: 3.0 | 0.45 | 0.49 | 83 | Yes | Continuous | Dripping speed: 1.93/h/additional amount: 1.70 |
| Example 4 | Cu: 20 Pd: 8.0 | 0.45 | 0.49 | 83 | Yes | Continuous | Dripping speed: 3.80/h/additional amount: 1.46 |
| Example 5 | Cu: 2.0 Pd: 0.2 | 0.45 | 0.49 | 73 | Yes | Continuous | Dripping speed: 1.94/h/additional amount: 1.94 |

TABLE 1-continued

| | Nickel Salt solution | | | | Additional Hydrazine | | |
|---|---|---|---|---|---|---|---|
| | Metal salt of metal that is nobler than Ni (Mass ppm to Ni) | Complexing agent Citric acid Trisodium (Molar ratio to Ni) | Reducing Agent Solution Initial hydrazine (Molar ratio to Ni) | Reaction Solution Reaction Initiation Temperature (° C.) | Addition | Method of Addition | Conditions for Addition of Hydrazine Dripping Speed (molar ratio/h to Ni), or Input Amount per Turn (molar ratio to Ni)/ Additional Amount (molar ratio to Ni) |
| Example 6 | Pd: 1.7 | 0.45 | 0.49 | 73 | Yes | Quartering | Equal each time: 0.49/additional amount: 1.94 |
| Example 7 | Cu: 2.0 Pd: 0.2 | 0.45 | 0.49 | 73 | Yes | Quartering | Equal each time: 0.49/additional amount: 1.94 |
| Example 8 | Cu: 5.0 Pd: 0.5 | 0.45 | 0.49 | 83 | Yes | Continuous | Dripping speed: 3.89/h/additional amount: 1.81 |
| Comparative Example 1 | Cu: 2.0 Pd: 0.2 | 0.11 | 2.43 | 60 | No | — | Additional amount: 0 |
| Comparative Example 2 | Cu: 5.0 Pd: 0.5 | 0.45 | 2.18 | 74 | No | — | Additional amount: 0 |
| Comparative Example 3 | Cu: 5.0 Pd: 0.5 | 0.45 | 2.43 | 84 | No | — | Additional amount: 0 |

TABLE 2

| | Amount in Nickel (% by mass) | | | Particle Diameter | | | Thermal Mechanical Analysis (TMA) | | |
|---|---|---|---|---|---|---|---|---|---|
| | Nitrogen (N) | Sodium (Na) | Sulfur (S) | Average Particle Diameter (μm) | CV Value (%) | Crystallite Diameter (nm) | Maximum Shrinkage Temperature (° C.)/ Maximum Shrinkage (%) | High Temperature Expansion Coefficient (%) | Laminate Evaluation Electrode Coverage Rate (Electrode Continuity) |
| Ex. 1 | <0.01 | <0.001 | 0.10 | 0.34 | 18.8 | 62.3 | 1110/16.3 | 0.3 | ✓ |
| Ex. 2 | <0.01 | <0.001 | 0.12 | 0.32 | 11.5 | 58.5 | 985/18.3 | 2.4 | ✓ |
| Ex. 3 | <0.01 | 0.002 | 0.18 | 0.21 | 16.2 | 43.5 | 1040/19.2 | 1.2 | ✓ |
| Ex. 4 | <0.01 | 0.002 | 0.31 | 0.12 | 14.3 | 32.8 | 1020/19.7 | 3.3 | ✓ |
| Ex. 5 | <0.01 | 0.002 | 0.11 | 0.35 | 15.5 | 55.5 | 1030/16.8 | 1.7 | ✓ |
| Ex. 6 | <0.01 | 0.002 | 0.13 | 0.30 | 24.2 | 52.4 | 860/17.1 | 3.7 | ✓ |
| Ex. 7 | <0.01 | <0.001 | 0.10 | 0.37 | 13.6 | 58.7 | 885/16.2 | 4.0 | ✓ |
| Ex. 8 | 0.01 | 0.002 | 0.19 | 0.20 | 10.1 | 40.8 | 1200/18.1 | 0 | ✓ |
| Com. Ex. 1 | 0.12 | 0.017 | 0.11 | 0.34 | 16.2 | 32.8 | 785/18.4 | 11.1 | ✗ |
| Com. Ex. 2 | 0.08 | 0.012 | 0.11 | 0.30 | 20.6 | 40.7 | 800/19.0 | 10.2 | ✗ |
| Com. Ex. 3 | 0.07 | 0.012 | 0.09 | 0.49 | 14.6 | 45.1 | 805/16.9 | 9.9 | ✗ |

EXPLANATION OF REFERENCE NUMBERS

1 Multilayer Ceramic Capacitor (Electronic Component)
10 Laminate
11 First Main Surface
12 Second Main Surface
13 First Side Surface
14 Second Side Surface
15 First End Surface
16 Second End Surface
20 Dielectric Layer
30 Internal Electrode Layer
35 First Internal Electrode Layer
36 Second Internal Electrode Layer
40 Outer Layer Portion
60 Base Layer
61 Plating Layer
100 External Electrode

The invention claimed is:

1. A nickel powder having a spherical particle shape, an average particle diameter of 0.05 μm to 0.3 μm, a crystallite diameter of 30 nm to 80 nm, and an amount of nitrogen of 0.02% by mass or less, wherein, when heating a pellet that is formed by pressurizing and molding the nickel powder from 25° C. to 1200° C. in an inert atmosphere or a reducing atmosphere and measuring a thermal shrinkage of the pellet based on a thickness of the pellet at 25° C., a maximum shrinkage temperature that is a temperature at a maximum shrinkage where the thermal shrinkage becomes maximum is 700° C. or more, the maximum shrinkage that is a maximum value of the thermal shrinkage at the maximum shrinkage temperature is 22% or less, and a maximum expansion amount of the pellet from the pellet at the maximum shrinkage based on the thickness of the pellet at 25° C. in a temperature range of the maximum shrinkage temperature or more and 1200° C. or less is 7.5% or less, and wherein a CV value indicating a ratio of a standard deviation of particle diameters of the nickel powder to the average particle diameter is 20% or less.

2. The nickel powder according to claim 1 further having an amount of an alkali metal element of 0.01% by mass or less.

3. The nickel powder according to claim 1, wherein sulfur is included at least on a surface of the nickel powder, and an amount of the sulfur is 1.0% by mass or less.

4. An internal electrode paste comprising nickel powder and organic solvent, wherein the nickel powder is constructed by the nickel powder according to claim 1.

5. A ceramic electronic components comprising at least an internal electrode, wherein the internal electrode is constructed by a thick film conductor formed with the internal electrode paste according to claim 4.

* * * * *